US009948013B2

(12) United States Patent
Houseworth et al.

(10) Patent No.: US 9,948,013 B2
(45) Date of Patent: Apr. 17, 2018

(54) MODULAR ELECTRICAL POWER TRANSFER DEVICE FOR INTEGRATED POWER PLATFORM

(71) Applicants: Steven D Houseworth, Carlock, IL (US); Bryan R Wilcox, Mahomet, IL (US); Mercedes Mane, Mahomet, IL (US); Dyson M Singer, Urbana, IL (US)

(72) Inventors: Steven D Houseworth, Carlock, IL (US); Bryan R Wilcox, Mahomet, IL (US); Mercedes Mane, Mahomet, IL (US); Dyson M Singer, Urbana, IL (US)

( * ) Notice: Subject to any disclaimer, the term of this patent is extended or adjusted under 35 U.S.C. 154(b) by 0 days.

(21) Appl. No.: 15/083,770

(22) Filed: Mar. 29, 2016

(65) Prior Publication Data

US 2017/0069979 A1 Mar. 9, 2017

Related U.S. Application Data

(60) Provisional application No. 62/213,886, filed on Sep. 3, 2015.

(51) Int. Cl.
*H01R 4/24* (2018.01)
*H01R 4/26* (2006.01)
(Continued)

(52) U.S. Cl.
CPC ..... *H01R 4/4818* (2013.01); *H01R 9/24* (2013.01)

(58) Field of Classification Search
CPC ..... H01R 4/4809; H01R 4/4818; H01R 11/09
(Continued)

(56) References Cited

U.S. PATENT DOCUMENTS 2,952,831 A 9/1960 Ehrlich
2,968,780 A * 1/1961 Roswell ..... H01R 4/4818 439/81
(Continued)

FOREIGN PATENT DOCUMENTS

CA 1309886 C2 11/1992

OTHER PUBLICATIONS

Inspectapedia, Back-wired Electrical Receptacle & Switch Connectors: Safe or Unsafe? © Copyright 2015 InspectApedia.com, available at http://Inspectapedia.com/electric/Electrical_Outlet_Backwired.php, last retrieved May 25, 2016.
(Continued)

*Primary Examiner* — Abdullah Riyami
*Assistant Examiner* — Thang Nguyen
(74) *Attorney, Agent, or Firm* — Wendy Thai

(57) ABSTRACT

The invention provides a modular electrical power transfer device that enables push-in, pull-out connection between electrical power supply wires and interface components. The electrical power transfer device includes at least two physically isolated electrical buses mounted within a non-conducting housing. Each electrical bus includes a blade connector and one or more wire shark-bite connectors. The wire shark-bite connectors can engage with electrical power supply wires, the resulting mechanical and electrical connections enable the electrical bus to receive power from the connected supply wires and redistribute electrical power to another device connected to the electrical bus. The blade connector can engage with a blade contact from an interface component, the resulting mechanical and electrical connections enable transfer of electrical power from the electrical bus to the interface component.

20 Claims, 7 Drawing Sheets

(51) Int. Cl.
*H01R 11/20* (2006.01)
*H01R 4/48* (2006.01)
*H01R 9/24* (2006.01)

(58) Field of Classification Search
USPC ..... 439/436–441, 787
See application file for complete search history.

(56) References Cited

U.S. PATENT DOCUMENTS 3,325,768 A 6/1967 Munroe
3,671,925 A 6/1972 Drapkin
3,916,149 A * 10/1975 Skinner ..... F24H 9/1818 219/536
3,945,711 A 3/1976 Hohorst et al.
4,012,100 A * 3/1977 Viscosi ..... H01R 27/02 439/439
4,046,449 A 9/1977 Ranzanigo
4,056,299 A * 11/1977 Paige ..... H01R 4/4818 439/225
4,103,125 A 7/1978 Marrero
4,106,835 A * 8/1978 Kimm ..... H01R 4/4818 439/441
4,165,443 A 8/1979 Figart et al.
4,223,971 A * 9/1980 Dola ..... H01R 4/2433 439/395
4,382,152 A 5/1983 Wideman et al.
4,627,675 A * 12/1986 Taylor ..... H01R 4/4818 439/535
5,033,112 A 7/1991 Bowling et al.
5,546,280 A * 8/1996 Hasebe ..... H01C 10/00 361/752
5,877,673 A * 3/1999 Kotani ..... H01R 4/4818 338/160
5,925,850 A 7/1999 Park
5,936,200 A 8/1999 Park
6,080,008 A * 6/2000 Frantz ..... H01R 4/4881 439/441
6,093,053 A * 7/2000 Horioka ..... H01R 4/26 439/444
6,095,848 A * 8/2000 Munshi ..... H01R 25/006 439/107
6,128,181 A * 10/2000 Higami ..... H01R 4/4818 174/252
6,156,971 A * 12/2000 May ..... H01R 24/76 174/59
6,617,511 B2 9/2003 Schultz
6,786,766 B1 * 9/2004 Chopra ..... H01R 4/4827 439/441
6,910,913 B1 * 6/2005 Satern ..... H01R 9/24 439/439
6,939,179 B1 9/2005 Kieffer et al.
6,945,815 B1 9/2005 Mullally
7,090,530 B1 * 8/2006 Dibble ..... H01R 4/4827 439/441
7,127,144 B2 10/2006 Lee
7,309,252 B2 * 12/2007 Fabian ..... H01R 4/2433 439/404
7,354,296 B1 * 4/2008 Katwala ..... H01R 4/34 439/107
7,357,652 B1 4/2008 Arenas et al.
7,767,905 B2 8/2010 Meyer
7,798,830 B2 9/2010 Schneider et al.
8,137,145 B2 3/2012 Joy
8,277,233 B2 10/2012 Su
8,283,802 B2 10/2012 Jansma et al.
8,371,863 B1 2/2013 Ganta et al.
9,136,641 B2 * 9/2015 Bishop ..... H01R 4/4836
2008/0045053 A1 * 2/2008 Stadler ..... H01R 4/4827 439/82
2010/0304597 A1 12/2010 Ilkhanov
2010/0304619 A1 12/2010 Joy
2013/0323960 A1 12/2013 Cao

OTHER PUBLICATIONS

Bob Jackson, Electrical Outlets: Side Wire Versus Back Wire, HandymanHowTo.com, 2011, available at https://www.handymanhowto.com/electrical-outlets-side-wire-versus-back-wire/, last retrieved May 25, 2016.

* cited by examiner 242
244
243
240

142S
d
144S
143S
140S 340
342
344
343

644
642
640
643

544
542
543
540

440
442
d
443
444

230
235
234
233
237
232
243
242
244
245
240

133S
135S
132S
c1
w1
430S
130S
143S
θ1
θ2
w2
w3
134S
c2
c3
137S
432S
140S 130S
135S
134S
137S
143S
142
144
145S
133S
132S
140S

MODULAR ELECTRICAL POWER TRANSFER DEVICE FOR INTEGRATED POWER PLATFORM

CROSS-REFERENCE TO RELATED APPLICATIONS

This application claims priority to U.S. provisional patent application No. 62/213,886, filed Sep. 3, 2015, the contents of which is incorporated herein by reference in its entirety.

BACKGROUND

The current electrical platform used in buildings consists of supply components, interface components, consuming components and regulation components. Supply components include power cables with electrical wires for supplying electrical power to interface components such as electrical outlets and switches. Outlets or receptacles provide an interface between the power supply and consuming components, for example, appliances such as a fan or floor lamp, while switches provide an "on" or "off" interface for controlling the supply of electrical power to other consuming components such as light fixtures. In these conventional electrical platforms, wires from the supply components attach directly to terminal screws located in the interface components. The direct connection between supply wires and interface components is hand-wired when the electrical system is installed and when an interface component requires servicing or replacement. And the hand-wiring that takes place during installation or subsequent servicing and repair involves repeated bending and unbending of electrical wires around terminal screws, a process that can weaken wire structural integrity and increase the risk of electrical shock or fire. Thus, a more efficient and less laborious mechanism for achieving electrical connection between electrical power supply wires and interface components for the transfer of electrical power between components is desirable.

SUMMARY

The invention provides an electrical power transfer device that decouples the direct connection of electrical power supply wires to interface components, as well as any component that transfers electrical power from the supply wires to consuming devices. The electrical power transfer device of the invention is modular and enables push-in installation and pull-out removal of components without the need for manipulating electrical supply wires. As such, the electrical power transfer device of the invention improves safety and allows for use without special tools or training. The electrical power transfer device of the invention also enables distribution of power to another device of the invention.

In one aspect, the invention provides an electrical bus that includes a body section to which at least one wire shark-bite connector and a blade connector adjoins. The body section includes a flat stem section and at least two flat branch sections extending perpendicularly from a side of the stem section, the branch sections being co-planar with the stem section to form a contiguous flat body. The wire shark-bite connector includes a pair of converging flexural tabs adjoining opposing edges of adjacent branch sections, the first flexural tab extending from a first branch section at a first angle with respect to the plane of the stem and branch sections toward the second flexural tab, the second flexural tab extending from a second and adjacent branch section toward the first flexural tab at a second angle to the plane of the stem and branch sections, the first and second angles being substantially similar in magnitude, the first and second flexural tabs being similarly sized, their free end portions converging forwardly of the plane of the stem and branch sections. The blade connector includes two plates joined by a midsection to form a slot for receiving a blade contact between the plates to enable an inserted blade contact to form mechanical and electrical connections with the blade connector, the blade connector adjoining the body of the electrical bus so as to be forward of the plane of the stem and branch sections and oriented to receive a blade contact advanced perpendicularly to the plane of the stem and branch sections.

In some embodiments, an electrical bus of the invention includes a blade connector having a U-shape structure.

In some embodiments, the blade connector of an electrical bus of the invention includes a second midsection joining the two plates to form a closed structure, the slot extending from the front to the rear of the blade connector.

In some embodiments, an electrical bus of the invention includes two, three, four, five or six wire shark-bite connectors disposed in vertical series along one side of the electrical bus.

In some embodiments where the electrical bus includes a plurality of wire shark-bite connectors disposed in vertical series along one side of the bus, the vertical series of wire shark-bite connectors can be downward from an upright, U-shape blade connector.

In some embodiments, an electrical bus of the invention is composed of a conductive spring material.

In some embodiments, an electrical bus of the invention is composed of copper, aluminum, brass, or a combination thereof.

In another aspect, the invention provides an electrical power transfer device that includes a non-conductive housing having a front and a rear cover and at least two electrical buses of the invention. Each electrical bus includes a flat reverse side mounted flush to the interior face of the rear housing cover, the wire shark-bite connector extending into the cavity of the device to effectively engage with a wire inserted through the rear housing cover, the blade connector extending toward the front housing cover to effectively engage with a blade contact inserted through the front housing cover, the electrical buses being physically and electrically separated one from the other. The front housing cover includes at least two blade interface ports on its face, each positioned to align with a blade connector on an electrical bus mounted within the device so as to enable a conductive blade contact advanced through the port to form mechanical and electrical connections with the blade connector. The rear housing cover includes at least two wire interface ports on its face, each positioned to align with a wire shark-bite connector on an electrical bus in the device so as to enable a wire advanced through the wire interface port to form mechanical and electrical connections with the wire shark-bite connector, and optionally, a similar number of wire shark-bite port release, each positioned to align with the flexural tab of a wire shark-bite connector.

In some embodiments where an electrical power transfer device of the invention includes a rear housing cover having at least two wire interface ports on its face, at least one of the wire interface ports is identified as corresponding to a neutral electrical bus, and at least one of the wire interface ports is identified as corresponding to a hot electrical bus, the ports being identified using one or more letters, a color code, a circumscribing ridge or indentation, or any combination thereof.

In some embodiments, an electrical power transfer device of the invention is adapted for use with an electrical receptacle-type interface component. As such, the device can include three physically isolated electrical buses, a front housing cover that includes three blade interface ports on its face, each positioned to align with a blade connector of one of the three electrical buses, and a rear housing cover that includes at least three wire interface ports on its face, each positioned to align with a wire shark-bite connector on one of the three electrical buses.

In some embodiments where an electrical power transfer device of the invention includes a rear housing cover having at least three wire interface ports on its face, at least one wire interface port is identified as corresponding to a neutral electrical bus, at least one wire interface port is identified as corresponding to a ground electrical bus, and at least one wire interface port is identified as corresponding to a hot electrical bus, the ports being identified using one or more letters, a color code, a circumscribing ridge or indentation, or any combination thereof.

In some embodiments where an electrical power transfer device of the invention includes three physically isolated electrical buses, each electrical bus can include two, three, four, five or six shark-bite connectors disposed in vertical series downward of a blade connector, and the rear housing cover can include six, nine, twelve, fifteen or eighteen wire interface ports, respectively, each aligned with a wire shark-bite connector on one of the three electrical buses.

In some embodiments, the electrical power transfer device of the invention is adapted for use with an electrical switch-type interface component. As such, the device can include four physically isolated electrical buses of the invention, a front housing cover that includes four blade interface ports on its face, each positioned to align with a blade connector of one of the four electrical buses, and a rear housing cover that includes at least four wire interface ports on its face, each positioned to align with a wire shark-bite connector on one of the four electrical buses.

In some embodiments wherein an electrical power transfer device of the invention includes a rear housing cover having at least four wire interface ports on its face, at least one wire interface port is identified as corresponding to a neutral electrical bus, at least one wire interface port is identified as corresponding to a ground electrical bus, at least one wire interface port is identified as corresponding to a hot electrical bus, and at least one wire interface port is identified as corresponding to a switched hot electrical bus, the ports being identified using one or more letters, a color code, a circumscribing ridge or indentation, or any combination thereof.

In some embodiments where the electrical power transfer device of the invention includes four physically isolated electrical buses, two of the four electrical buses can include a blade connector and four wire shark-bite connectors disposed in vertical series downward of the blade connector, one of the four electrical buses can include a blade connector and three wire shark-bite connectors disposed in vertical series downward of the blade connector, and one of the four electrical buses can include a blade connector and one wire shark-bite connector.

In some embodiments, the electrical power transfer device of the invention is adapted for use with an electrical switch-type interface component. As such, the device can include four physically isolated electrical buses: (a) a first and a second electrical bus, each having four wire shark-bite connectors disposed in vertical series along one side of the electrical bus downward of an upright, U-shape blade connector; (b) a third electrical bus that has three wire-shark bite connectors disposed in vertical series along one side of the electrical bus downward of an upright, U-shape blade connector; and (c) a fourth electrical bus that includes a wire-shark bite connector upward of an inverted, U-shaped blade connector. The front housing cover can include four blade interface ports on its face, and the rear housing cover can include twelve wire interface ports on its face, each blade or wire interface port being positioned to align with a blade connector or a wire shark-bite connector, respectively, of an electrical bus in the device.

In some embodiments where an electrical power transfer device of the invention includes a rear housing cover having twelve wire interface ports on its face, four wire interface ports are identified as corresponding to a neutral electrical bus, four wire interface ports are identified as corresponding to a ground electrical bus, three wire interface ports are identified as corresponding to a hot electrical bus, and one wire interface port is identified as corresponding to a switched-hot electrical bus, the ports being identified using one or more letters, color code, circumscribing ridge or indentation, or any combination thereof.

In another aspect, the invention provides a non-conductive housing having a front housing cover and a rear housing cover that combine to form an closed rectangular box having an inner cavity effective to house at least two electrical buses of the invention mounted to an interior surface of the rear housing cover, the reverse sides of the electrical buses flush against the interior surface, the electrical buses being physically isolated one from the other. The non-conductive housing has a front housing cover that includes at least two blade interface ports, each positioned to align with a blade connector on one of the electrical buses when the buses are mounted to the interior surface of the rear housing cover. The non-conductive housing also has a rear housing cover that includes at least two wire interface ports, each positioned to align with a wire shark-bite connector on one of the electrical buses when the buses are mounted to an interior surface of the rear housing cover.

An electrical power transfer device of the invention functions as a central wiring module for connecting electrical supply wires on one side, i.e. rear, and interface devices on the other side, i.e. front. Electrical supply wires are permanently or semi-permanently attached to a device of the invention, while interface components can be pushed on to attach and pulled off to remove. A device of the invention includes multiple electrical supply wire ports to provide electrical connections to other interface components or electrical consuming components. The invention provides the added benefits of: (1) reducing the possibility of electrical shock; (2) reducing the potential of shorting or fires from exposed electrical wires; (3) simplifying removal and/or installation by enabling connection with push-on and pull-off interface component connections; and (4) eliminating the need for wire nuts to secure additional electrical wires to supply power for additional consuming devices.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

Each patent or publication cited herein is hereby incorporated by reference in its entirety. Applicants reserve the right to physically incorporate into this specification any and all materials and information from any cited patents or publications.

Other features and advantages of the invention will be apparent from the following detailed description and from the claims.

DETAILED DESCRIPTION

The invention provides an electrical power transfer device that decouples the direct connection of electrical power supply wires to interface components or any component that transfers electrical power from the supply wires to consuming devices. An electrical power transfer device of the invention is modular and enables electrical connections between a power source, an interface component, and another power transfer device to be made in a snap-in and pull-out fashion, thereby providing improved safety and allows for use without special tools or training. An electrical power transfer device of the invention includes a housing made of non-conducting material and at least two electrical buses, each secured within the interior of the housing so as to be physically and electrically isolated. An electrical power transfer device of the invention can be used to concurrently receive electrical power from a power source and redistribute the power to an interface component and/or to one or more electrical power transfer devices in a network.

Electrical Bus

Figure 2:
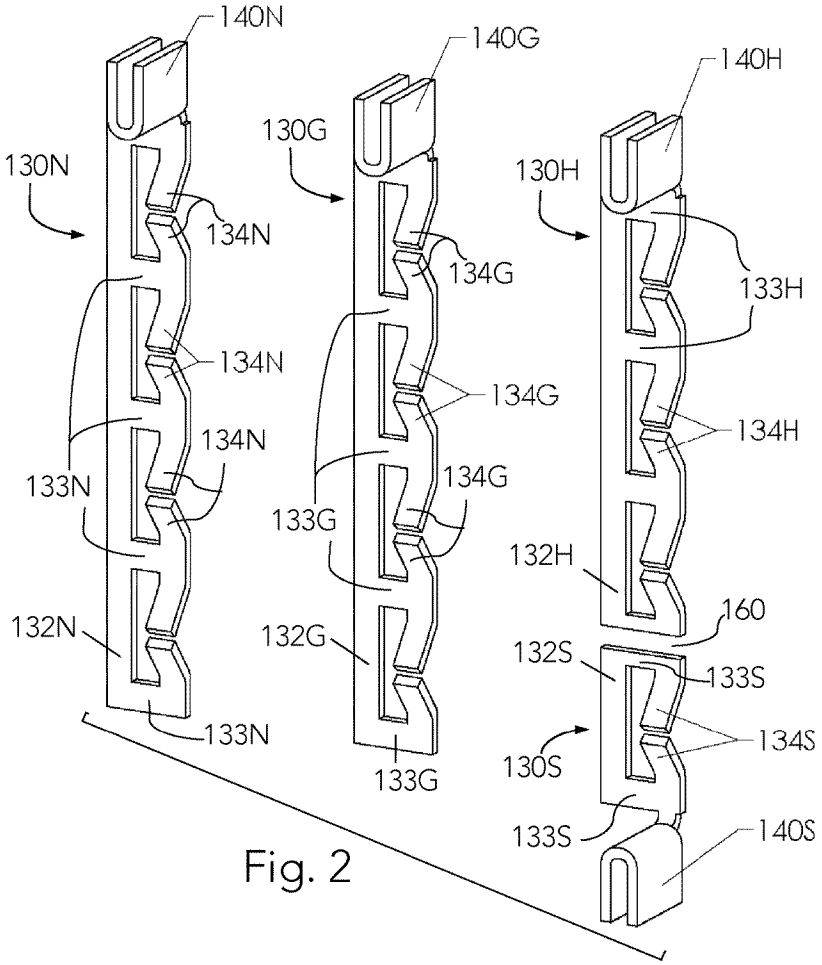
FIG. 2 is a perspective view of electrical buses 130N, 130G, 130H and 130S from their obverse as arranged and mounted to the interior of electrical power transfer device 100.

An electrical power transfer device of the invention includes at least two electrical buses. Each electrical bus has a generally flat reverse side mounted substantially flush against the interior surface of the rear cover of the device housing, and an obverse side facing into the cavity of the device. The body of the electrical bus includes a flat, stem section with at least two co-planar branch sections projecting from the same side of the stem section, e.g. from the left or right edge of the stem section. Each electrical bus includes at least one wire shark-bite connector and a blade connector extending into the cavity of the device toward the front cover of the device housing at an angle to the coplanar stem and branch sections. Non-limiting examples of electrical buses of the invention are illustrated in FIG. 2. Electrical buses 130N, 130G, 130H and 130S include: (1) stem 132N, 132G, 132H, and 132S, respectively; (2) coplanar branches 133N, 133G, 133H, and 133S, respectively; (3) wire shark bite connectors 134N, 134G, 134H, and 134S, respectively; and (4) blade connectors 140N, 140G, 140H, and 140S, respectively.

A wire shark-bite connector of the invention includes a pair of opposing flexural tabs, each flexural tab having a fixed end and a free end portion. The fixed ends of opposing flexural tabs adjoin opposing edges of adjacent branch sections of the electrical bus. The free end portions of opposing flexural tabs extend one towards the other at angle $\theta$ to the interior surface of the rear cover to which the bus is mounted to converge within the cavity of the device. The converging free ends of opposing flexural tabs are effective to grip an exposed wire inserted between the tabs to form and maintain good physical and electrical contact with the inserted wire. Outward movement of the inserted wire against the direction of insertion or withdrawal of the inserted wire is limited as any such movement causes the free ends of the pair of opposing flexural tabs to further converge, pressing into the inserted wire.

Figures 6A, 6B, 6C, 7A, 7B, 7C, 7D, 8A, 8B, 8C:
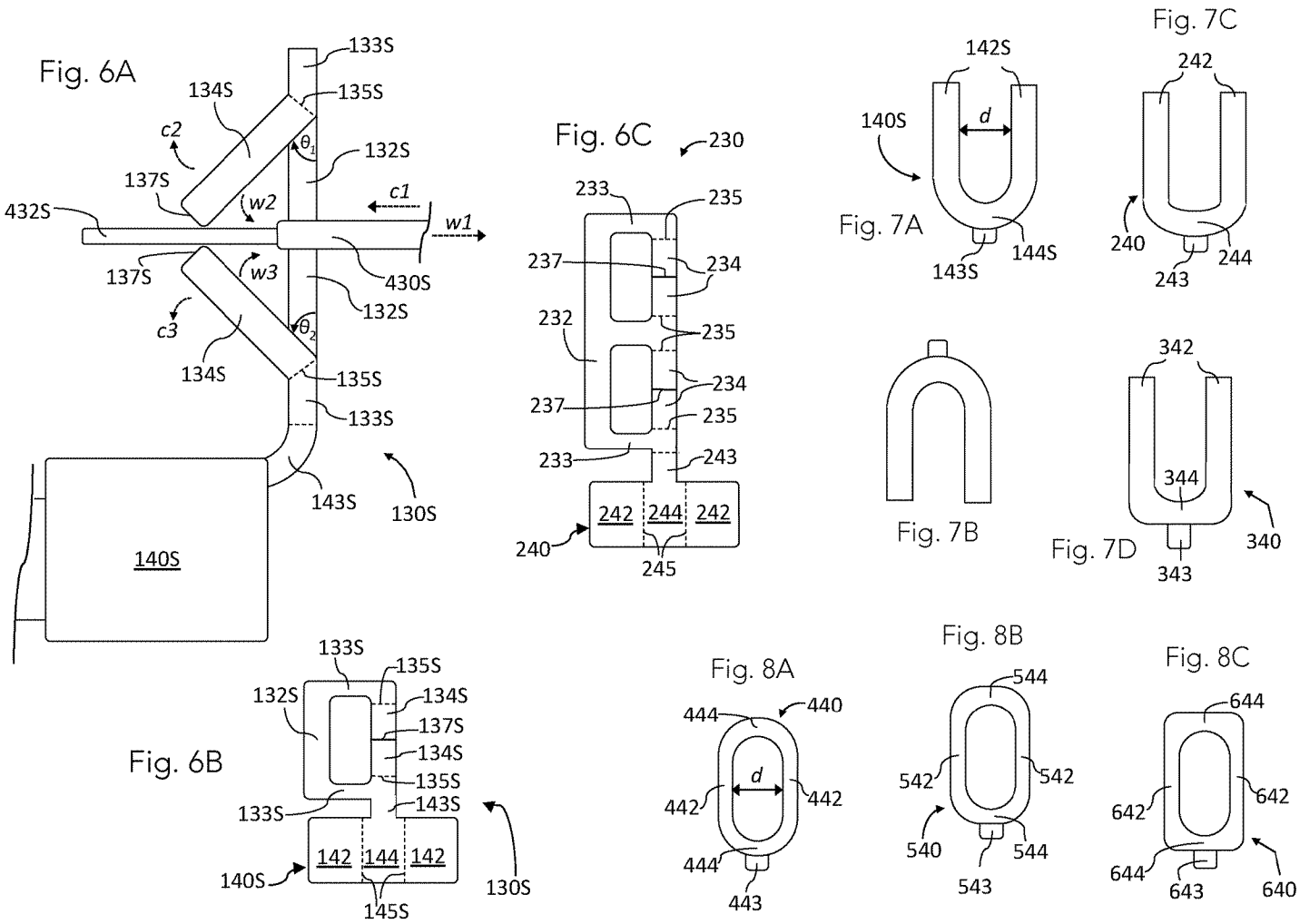
FIGS. 6A-6C are three views of two embodiments of the invention including a side view of electrical bus 130S (6A), a plan view of a flat conductive material from which electrical bus 130S can be formed (6B), and a plan view of a flat conductive material from which electrical bus 230 having two shark-bite connectors can be formed.
FIGS. 7A-7D are front side views of blade connectors having an open structure with a circular, semi-circular, or straight midsection including views of blade connector 140S with a circular midsection (7A), blade connector 140S in an inverted orientation (7B), blade connector 240 with a semi-circular midsection (7C), and blade connector 340 with a straight midsection (7D).
FIGS. 8A-8C are front side views of blade connectors having closed structures with circular, semi-circular or straight midsections including views of blade connector 440 with flat plates 442 joined by two circular midsections 444 (8A), blade connector 540 with flat plates 542 joined by two semi-circular midsections 544 (8B), and blade connector 640 with flat plates 642 joined by two straight midsections 644 (8C).

A non-limiting example of a shark-bite connector of the invention can be found in electrical bus 130S illustrated in FIG. 2 and FIG. 6A. Electrical bus 130S has a single shark-bite connector formed by the pair of opposing flexural tabs 134S, each of which includes fixed end 135S and free end portion 137S (FIG. 6A). Fixed ends 135S, which are represented by the dotted lines, adjoin opposing edges of adjacent branch sections 133S, and free end portions 137S extend, one member toward the other member of the pair, at angle $\theta_1$ and $\theta_2$ to converge forwardly of the plane of coplanar stem section 132S and branch section 133S. Insertion of wire 430S in the direction indicated by the arrow c1, causes opposing flexural tabs 134S to flex in the direction indicated by arrows c2 and c3. Withdrawal of inserted wire 430S in the direction indicated by arrow w1, causes opposing flexural tabs 134S to flex in the direction indicated by arrows w2 and w3 to press into wire 430S to limit outward movement of the wire in the direction of w1.

Angles $\theta_1$ and $\theta_2$ of the opposing flexural tabs are substantially similar and can be of any magnitude sufficient to allow the free ends of the pair of flexural tabs to engage with a wire inserted between the flexural tabs. In some embodiments, for example, in an unflexed state or where no wire is inserted between the pair of opposing flexural tabs, angles $\theta_1$ and $\theta_2$ can be 0°. In other embodiments, angles $\theta_1$ and $\theta_2$ can be greater than 0°, for example and without limitation, about 1°, about 2°, about 3°, about 4°, about 5°, about 6°, about 7°, about 8°, about 9°, about 10°, about 11°, about 12°, about 13°, about 14°, about 15°, about 20°, about 25°, about 30°, about 35°, about 40°, about 45°, or more. The edges of the free end portions of the pair of opposing flexural tabs can be touching, for example, where no wire is inserted between the tabs, or separated by a distance approximating the diameter of a wire to allow engagement with the wire. Thus, the distance between the edges of the free end portions of the pair of opposing flexural tabs can be between about 0.05 mm to about 12 mm, for example, about 0.08 mm, about 0.1 mm, about 0.2 mm, about 0.4 mm, about 0.8 mm, about 1.6 mm, about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, about 10 mm, about 10.5 mm, about 11 mm, about 11.5 mm or about 12 mm for engaging with a wire of any gauge, for example, about 4/0, about 3/0, about 2/0, about 1/0 American wire gauge (AWG) or a gauge from about 1 to about 40 AWG.

Thus, when mounted to the interior rear cover of a device of the invention, opposing flexural tabs can be extended into the cavity of the device, bending away from the interior surface of the rear cover of the device housing to which the bus is mounted at any acute angle including, for example, at about 1°, about 2°, about 3°, about 4°, about 5°, about 6°, about 7°, about 8°, about 9°, about 10°, about 11°, about 12°, about 13°, about 14°, about 15°, about 20°, about 25°, about 30°, about 35°, about 40°, about 45°. Preferably, the members of the pair of flexural tabs extend into the cavity of the device, bending away from the interior surface of the rear housing cover, at substantially similar acute angles so as to make contact at a substantially similar region along an inserted wire.

An electrical bus of the invention can include one shark-bite connector or more than one wire shark-bite connectors, for example, two, three, four or more than four wire shark-bite connectors. Where an electrical bus of the invention includes a plurality of wire shark-bite connectors, the shark-bite connectors can be positioned uniformly on the electrical bus, and optionally, on the same side of the bus. FIG. 2 provides non-limiting examples of electrical buses with one, three and four shark-bite connectors disposed uniformly on the same side of the bus.

An electrical bus of the invention also includes at least one blade connector, which can be disposed at any convenient position on the electrical bus, for example and without limitation, at one end of the electrical bus. The blade connector can have any shape or structural configuration so long as it includes two opposing plates attached to form a slot effective to receive a blade contact and enable the inserted blade contact to form secure mechanical and electrical connections with the opposing plates. The opposing plates can be attached through one or two midsections, and optionally, an end-section to form a blade connector with an open or closed structure.

The blade connector can have an open U-shape structure formed by two opposing side plates joined by a midsection that can be straight or arcuate to form a slot for receiving a conducting blade contact. The arcuate midsection can be round or semi-round. Non-limiting examples of blade connectors having an open structure are provided in FIGS. 7A-7D and include blade connector 140S with opposing side plates 142S and rounded midsection 145S; blade connector 240 with flat, opposing side plates 242 and semi-rounded midsection 245; and blade connector 340 having flat, opposing side plates 342 and straight midsection 344.

The width d of the slot, which is based on the distance between the inner, opposing surfaces of the flat side plates, is dimensioned to allow a blade contact to (1) securely fit within the slot and (2) achieve and maintain sufficient mechanical contact with the blade connector so as to achieve and maintain an electrical connection with the blade connector.

The blade connector can have a modified U-shape structure in which the plates include portions that converge to form a constriction and/or edges that flare to form flanges.

The blade connector can have a closed structure, for example, a four- or five-sided short tubular structure having a generally oval, square or rectangular cross-section and an interior slot. Where the blade connector has a four-sided tubular structure, the blade connector can include two opposing plates joined by two opposing midsections, the slot formed by opposing plates and midsections extending from one open end to the other open end of the tubular blade connector. Where the blade connector has a five-sided short tubular structure, the blade connector can include two opposing plates joined by two opposing midsections and an end-section. In these embodiments, the slot formed by opposing plates and midsections extends from the open front to a closed or partially-closed end of the blade connector formed by the end-section.

The opposing plates and midsections can form a blade connector having a generally oval, square or rectangular cross-section with sharp or rounded corners so long as the slot between opposing plates is effective to receive a blade contact and enable the inserted blade contact to establish secure mechanical and electrical connections with the opposing plates of the blade connector. Each midsection or end-section of a blade connector of the invention can be independently straight, square, or arcuate. Where arcuate, each midsection or end-section can be independently round or semi-round. Thus, a closed blade connector can have two midsections and optionally an end-section that are straight, round, semi-round, or a combination thereof.

Non-limiting examples of blade connectors with closed structures are illustrated in FIGS. 8A-8C and include blade connector 440 with flat, opposing side plates 442 and rounded midsections 445; blade connector 540 with flat, opposing side plates 542 and semi-rounded midsections 545; and blade connector 640 having flat, opposing side plates 642 and straight midsections 644. Irrespective of external shape or configuration of the blade connector, the slot of a blade connector of the invention is dimensioned to allow a blade contact to (1) be securely inserted into the slot and (2) achieve and maintain sufficient mechanical contact with the blade connector so as to achieve and maintain an electrical connection with the blade connector.

The blade connector can be disposed on the body of the electrical bus at any convenient location, for example, adjoining any portion of the branch or stem section of the electrical bus. The blade connector can be disposed at or near an end of the electrical bus. The blade connector can be oriented in any direction with respect to the structure of the electrical bus. The blade connector can be oriented vertically, horizontally, or at an angle with respect to the body of the electrical bus. A blade connector is oriented vertically with respect to the body of the electrical bus when its opposing plates are generally parallel to the stem section of the electrical bus body. A blade connector is oriented horizontally with respect to the body of the electrical bus when its opposing plates are generally perpendicular to the stem section of the electrical bus body. A blade connector is at an angle with respect to the body of the electrical bus when its opposing plates are at an acute or obtuse angle to the stem section of the electrical bus body.

Where the blade connector is in a vertical orientation, the blade connector can be upright (FIG. 7A) or inverted (FIG. 7B). Thus where the blade connector has an open structure, for example, where the blade connector is U-shaped (FIGS. 7A-7D), the blade connector can adjoin the stem or branch section of the electrical bus at any convenient position on the electrical bus, for example, at one end of the electrical bus, in an upright configuration exemplified by electrical bus 130N, 130G and 130H or in an inverted configuration as exemplified by switched hot bus 130S (FIG. 2). A blade connector of the invention can adjoin the body section of the electrical bus through a short extension, non-limiting examples of which include extension 143S (FIGS. 6A-6B, 7A), extension 143 (FIG. 6C), extension 243 (FIG. 7C), extension 343 (FIG. 7D), extension 443 (FIG. 8A) extension 543 (FIG. 8B), and extension 643 (FIG. 8C).

An electrical bus of the invention can be integrally formed with one or more shark-bite connectors and blade connectors or formed by joining two or more sections using methods including, for example, by welding, bolting or clamping as known to those skilled in the art. Preferably, an electrical bus of the invention is integrally formed, for example, with a blade connector and one or more shark-bite connectors, from a sheet of conductive material as illustrated in FIGS. 6B and 6C, respectively. Electrical bus 130S can be formed from a sheet of conducting material shaped as illustrated in FIG. 6B. Dotted lines 135S indicate fixed ends of flexural tabs 134S that adjoin opposing edges of adjacent branch sections 133S, and line 137S indicates the edges of the free end portions of flexural tabs 134S. Dotted lines 145S generally delineate the straight or arcuate midsection 144 from flat side plates 142 of the blade connector 140S. Electrical bus 230 can be formed from a sheet of conducting material shaped as illustrated in FIG. 6C. Dotted lines 235 indicate fixed ends of flexural tabs 234 that adjoin opposing edges of adjacent branch sections 233, and line 237 indicates the edges of the free end portions of flexural tabs 234. Dotted lines 245 generally delineate the straight or arcuate midsection 244 from flat side plates 242 of blade connector 240.

An electrical bus of the invention can be formed using any conductive spring material of suitable resiliency, strength, and electrical conductivity known to those skilled in the art. Useful conductive spring materials can have a density between about 0.282 to about 0.32 $lb/in^3$; a minimum tensile strength between about 100 to about 399 $psi \times 10^6$; modulus elasticity between about 15 to about 32 $psi \times 10^6$; modulus torsion between about 6.25 to about 12 $psi \times 10^6$; and/or operating temperature between about 150° F. to about 1100° F. An electrical bus of the invention can be formed using high carbon steel, high temperature alloy, alloy steel or stainless steel or a non-ferrous material. It can be formed using, for example, copper, brass or aluminum.

Device Housing

The housing of a device of the invention includes a front cover and a rear cover constructed of any non-conductive materials. The front and rear covers are generally of similar sizes, each of which includes a face portion to which a top, bottom, right and left sections perpendicularly adjoin. The face portions of the front and rear cover include one or more blade and wire interface ports, respectively. The top, bottom, right and left sections of the front and rear cover combine to form the top, bottom, right and left surfaces of the device housing. The front and rear cover can be permanently or removably secured one to the other using any means known to those skilled in the art including adhesive, one or more fasteners such as screws, rivets or adhesives, as well as a snap fit mechanism involving an annular, cantilever or torsional type snap fit joint. Non-conductive materials that can be used to construct the front or rear cover are known to those skilled in the art and include, without limitation, ceramic, resins including plastic resins, or a synthetic plastic polymer such as polyvinyl chloride (PVC).

The front cover of the housing includes at least two blade interface ports, and the rear cover includes a plurality of wire interface ports and optionally a plurality of wire port release. Thus, the device housing can include at least four blade interface ports on its front and a plurality of wire interface ports on its rear. The ports located on the front or rear cover are positioned to directly align with a blade connector or a wire shark-bite connector on an electrical bus mounted within the device housing. For each wire interface port, a device of the invention can optionally include a wire port release through which an inserted wire that is physically and electrically connected to a device of the invention can be disconnected from the device of the invention as further discussed below. Thus, the number of blade interface ports and wire shark-bite interface ports correspond with the number of blade connectors and wire shark bite connectors on the electrical buses within the device, respectively. Similarly, the number of wire port release in a device of the invention can correspond to the number of wire shark bite connectors and wire interface ports in the device.

The blade interface ports are each dimensioned to receive a blade contact from an interface component and each is configured to guide the blade contact to the slot between the plates of a blade connector disposed within the cavity of the device directly rearward of the blade interface port with which it aligns as the blade contact is advanced through the port. Optionally, each blade interface port can be designated as corresponding to a neutral, ground, hot, or switched-hot electrical bus within the housing. Any means known to those skilled in the art can be used to identify the blade interface port as corresponding to a neutral, ground, hot or switched-hot electrical bus including words, letters and/or conventional color-codes. The four blade interface ports can be disposed on the face of the housing in any position or arrangement convenient for use with an interface component so long as each port directly aligns with a blade connector disposed within the device housing so as to effectively guide a blade contact to the slot between the plates of a blade connector to achieve good electrical contact with the plates. For example, three blade interface ports can be positioned in horizontal alignment across a top portion of the front face of the device, while the fourth blade interface port can be positioned in vertical alignment with one of the first three blade interface ports at a lower portion of the front face of the device.

The wire interface ports are each dimensioned to receive at least the exposed end of a wire stripped of insulating material, and optionally can be dimensioned to also receive a portion of the insulated end of a conductor wire of an electrical power cable. Each wire interface port is configured to guide the end of a wire to a wire shark-bite connector within the cavity of the device directly rearward of the wire interface port with which it aligns, as the wire end is advanced through the port. The plurality of wire interface ports can be disposed on the face of the housing in any position or arrangement convenient for connecting with the conductor wires of a power cable so long as each port directly aligns with a wire shark-bite connector of an electrical bus disposed within the device housing so as to effectively guide a wire to the space between the flexural tabs of the shark-bite connector to achieve good electrical contact with the flexural tabs.

A device of the invention can include at least one set of two wire interface ports, each port for a neutral or hot/positive wire. A device of the invention can include at least one set of three wire interface ports, each port to accommodate a neutral, ground, or hot/positive wire. A device of the invention can include more than one set of wire interface ports, each set consisting of two or three wire interface ports. Thus, the number of wire interface ports in a device of the invention can be a multiple of two or three. For example, a device of the invention can include two, four, six, eight, ten, or twelve or more wire interface ports, as a device of the invention can include one, two, three, four, five, or six or more sets of two wire interface ports. A device of the invention can include three, six, nine, twelve, fifteen, or eighteen or more wire interface ports, as a device of the invention can include one, two, three, four, five, or six or more sets of three wire interface ports. The wire interface ports can be arranged any configuration convenient for attachment of power supply wires or to a power cable. The wire interface ports can be position in a matrix pattern in which each column of a two-column arrangement of ports correspond to neutral or hot/positive wire interface port. The wire interface ports can be position in a matrix pattern in which each column of a three-column arrangement of ports correspond to neutral, ground, or hot/positive wire interface port.

Each wire interface port or grouping of wire interface ports can be designated as corresponding to a neutral, ground, hot, or switched-hot electrical bus within the housing. Any means known to those skilled in the art can be used to identify the wire interface port as corresponding to a neutral, ground, hot or switched-hot electrical bus including words, letters and/or conventional color-codes. Alternatively, each set of three wire interface ports, i.e. a neutral, ground, and hot or switched-hot port, can be identified as a functional grouping or set using any means known to those skilled in the art including indentations or ridges on the housing surrounding the members of a grouping or set.

A device of the invention can optionally include one or more wire port release through which an inserted wire that is physically and electrically connected to a device of the invention through engagement with a shark-bite connector can be disconnected. The one or more wire port release can be an opening of any shape or size effective for insertion of a slender rigid instrument such as a screwdriver or the like to flexing the free end portion of a flexural tab away from an inserted wire with which it engages so as to free the inserted wire from the shark-bite connector. As such, the wire port release can be located at any convenient location on the rear cover so long as it aligns sufficiently with at least one flexural tab so as to provide access to the flexural tab. Thus, a device of the invention can be used to permanently or semi-permanently connect power supply wires for multiple components without the use of wire nuts. Wires connected to a device of the invention can be released from the shark bite connector without cutting.

The invention provides a modular electrical power transfer device through which electrical connections between a power source, an interface component, and another power transfer device can be made in a snap-in and pull-out fashion. As such, electrical connections can be made without repeated bending and unbending of electrical supply wires thereby simplifying installation, removal and replacement of interface components. In addition, because electrical connections are made within the electrical transfer device, bare wires do not extend outside the housing of the device. Thus, a device of the invention is touch-safe, and the risk of electrical shorting due to contamination by dust, debris, and insects is reduced, as is potential for damage or injury due to electrical shorting. A device of the invention is typically box-shape and can be dimensioned to fit within a conventional receptacle housing. It is backward compatible with the conventional electrical platform as it conforms to the NEMA form factor standards for receptacle boxes thereby providing additional convenience for the user.

Specific embodiments of the invention are described in the following examples, which do not limit the scope of the invention described in the claims.

EXAMPLES

Example—1: Electrical Power Transfer Device 100

Figure 1B:
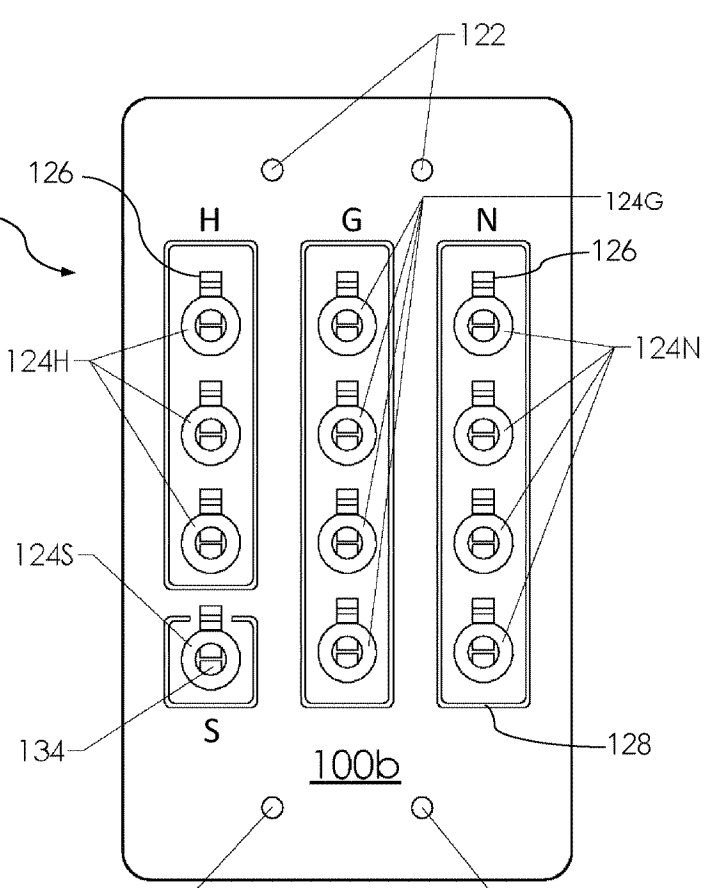
FIGS. 1A-1B are three views of electrical power transfer device 100 of the invention including a front view (1A), a rear view (1B) and a sectional view taken along lines 1C-1C of FIG. 1A.
Figure 1A:
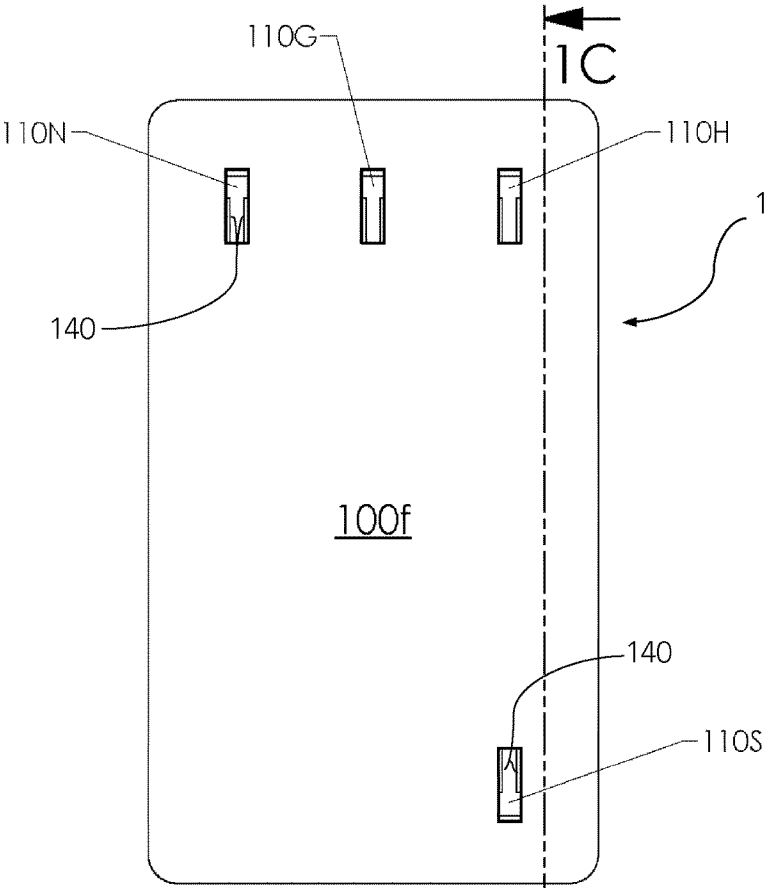
Figure 1C:
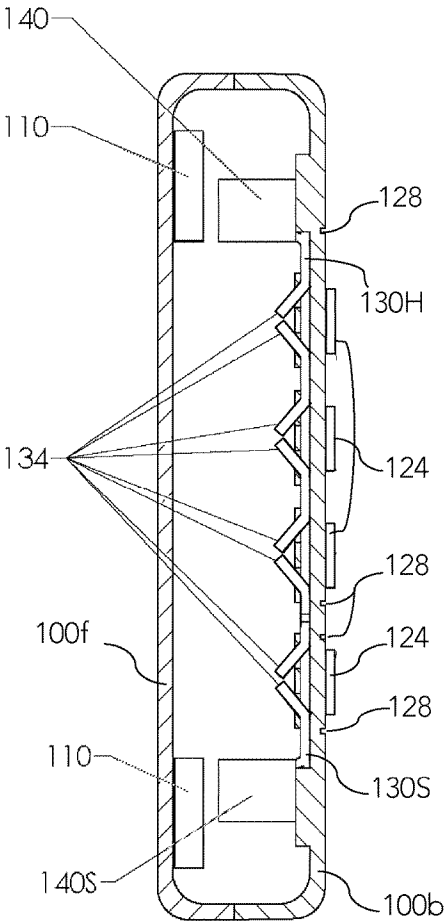
Figure 3:
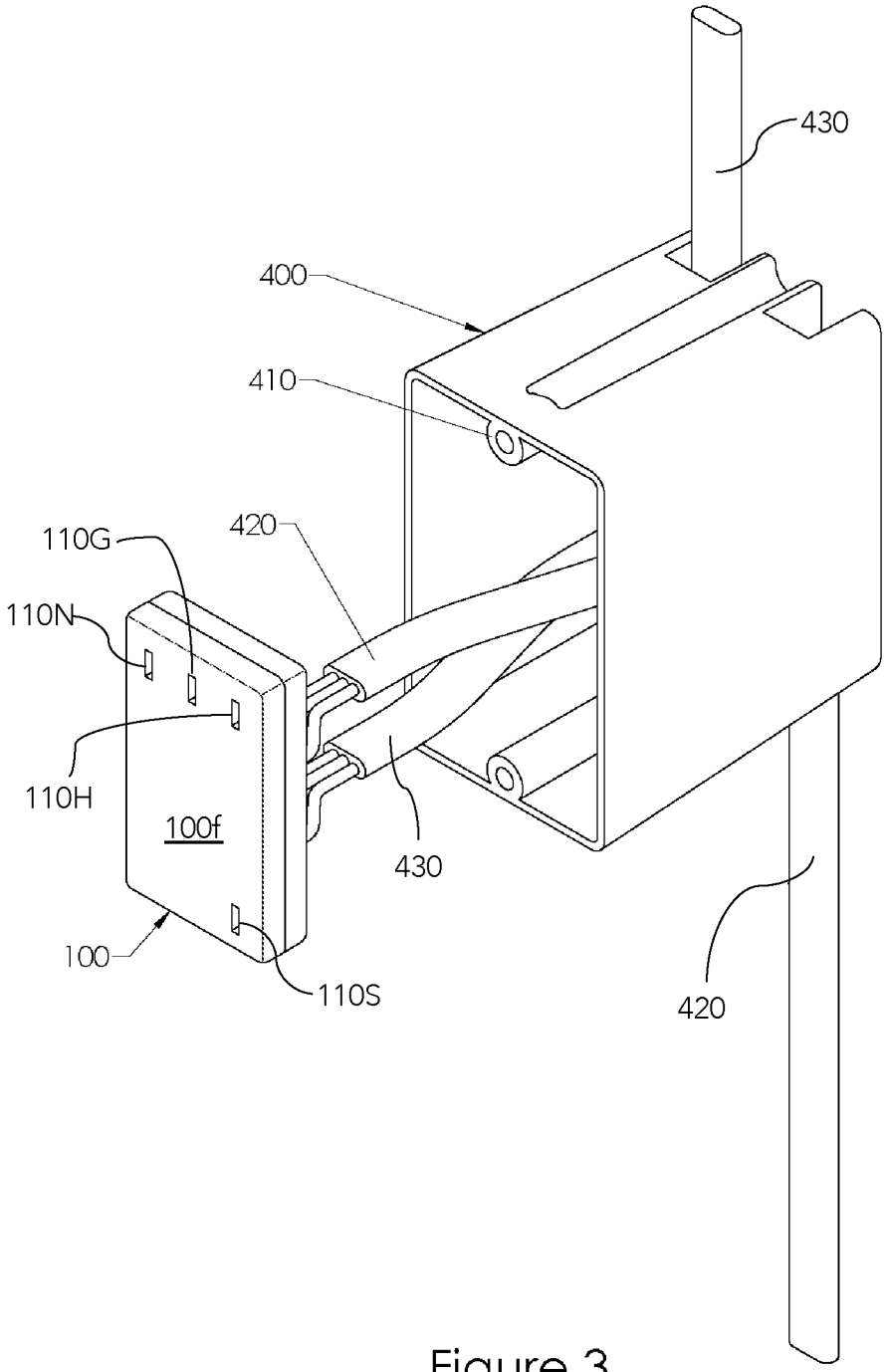
FIG. 3 is a perspective view of electrical power transfer device 100, which is connected to supply cable 420 within receptacle box 400.

FIGS. 1A-1C of the drawings provide three views of electrical power transfer device 100. Device 100 has a rectangular cuboid or rectangular box-shaped housing made of a non-conducting material having a front cover 100*f* and rear cover 100*b*. See FIGS. 1A-1C, FIG. 3 and FIGS. 4A & 4B. Front and rear cover 100*f* and 100*b* each includes a larger flat rectangular face adjoining smaller top, bottom and two side rectangular sections (FIG. 1C, FIG. 3 and FIGS. 4A & 4B). Front and rear cover 100*f* and 100*b* are similarly sized and dimensioned to form a closed housing (FIG. 1C, FIG. 3, and FIGS. 4A & 4B). Front and rear cover 100*f* and 100*b* are held together using one or more screws, rivets or fasteners (not shown) inserted through retention holes 122 on rear cover 100*b* (FIG. 1B).

The face of front cover 100*f* (FIG. 1A) is provided with four of slots 110, i.e., blade interface ports 110N, 110G, 110H and 110S. Each blade interface port 110 is a thin, generally rectangular opening dimensioned to accommodate a blade contact of an electrical interface component such as a receptacle or switch. Each blade interface port 110 extends from the front through front cover 100*f* into the interior of device 100 (FIG. 1C) in direct alignment with blade connector 140 of an electrical bus disposed within device 100. Each blade interface port 110 directly aligns with blade connector 140 in that each port 110 is positioned on the face of front cover 100*f* so as to be directly forwardly of blade connector 140 when viewed from the front of device 100. So configured, a blade contact advanced through blade interface port 110 from the front of device 100 is guided to the socket of blade connector 140 to securely engage with blade connector 140 thereby forming mechanical and electrical connections therewith.

Blade interface port 110 can be disposed on front cover 100*f* at any convenient position so long as each blade interface port 110 is directly forward of or aligns with the blade connector of an electrical bus within device 100. For example, three blade interface ports 110, e.g. neutral port 110N, ground port 110G and hot port 110H, are aligned horizontally across front cover 100*f* as shown in FIG. 1A. Each port is directly forward of the blade connector of a neutral, ground or hot electrical bus within device 100 so as to enable an inserted blade contact to form secure mechanical and electrical connections with device 100. Switched-hot blade interface port 110S is positioned to be physically separated from neutral port 110N, ground port 110G, and hot port 110H, typically beneath or in vertical alignment with hot port 110H, for example, at a lower portion of front cover 100*f* as illustrated in FIG. 1A. Switched-hot blade interface port 110S is disposed forwardly of blade connector 140 of a switched-hot electrical bus within device 100. As such, an interface component having a neutral, ground, hot, and switched-hot blade contact is electrically connected to device 100 by insertion of the neutral, ground, hot, and switched-hot blade contacts of the interface component into blade interface ports 110N, 110G, 110H, and 110S.

In some embodiments, the front cover of a device of the invention can include one or more port function indicators on its surface identifying the blade interface ports as corresponding to a neutral, ground, hot, or switched-hot electrical bus disposed within the device. Any form of markings effective to indicate the function of the blade interface ports can be used including colors or letters. Where letters are used as identifiers, the letters N, G, H and S can be included to designate a port as corresponding to a neutral, ground, hot, or switched-hot electrical bus, respectively. Where colors are used as identifiers, for example, colored bands or strips surrounding or outlining each interface port, any conventional color codes can be utilized. For example, white can be used to indicate a neutral wire, green or yellow for a ground wire, and black or red for a hot or switched hot wire.

The face of rear cover 100*b* (FIG. 1B) is provided with plurality of circular openings 124, in particular, neutral, ground, hot, and switched-hot wire interface ports 124N, 124G, 124H and 124S, respectively. Each wire interface port is dimensioned to receive a wire conductor from an electrical power cable. Each wire interface port 124 extends from the exterior rear of the device 100 through rear cover 100*b* into interior of device 100 (FIG. 1C) in direct alignment with a shark-bite connector on an electrical bus disposed within device 100. Each wire interface port 124 directly aligns with a shark-bite connector 134 in that each wire interface port 124 is positioned directly rear of a wire shark-bite connector 134 when viewed from the front of device 100, or positioned directly forward of or in-line with wire shark-bite connector 134 when viewed from the rear of device 100. So configured, a wire advanced through wire interface port 124 from the rear of device 100 is directed between opposing bites of wire shark-bite connector 134, the opposing bites of connector 134 gripping the inserted wire to form secure mechanical and electrical contact with the inserted wire and to limit withdrawal of the wire once inserted. Thus, wire interface ports 124 enable an electrical power cable to electrically connect with device 100 through insertion of the neutral, ground, and hot wires of the power cable into wire interface ports 124N, 124G and 124H/124S, respectively, to form mechanical and electrical connections with an electrical bus within the device.

Wire interface ports 124 can be disposed on rectangular face of rear cover 100*b* in any convenient positions or patterns so long as each wire interface port 124 aligns with or is directly forward of a shark-bite connector on an electrical bus within the device housing as view from the rear. Preferably, wire interface ports 124 are positioned in columns and rows uniformly arranged in a grid-like pattern or matrix, for example, twelve of wire interface ports 124 arranged in three columns and four rows as illustrated in FIG. 1B.

Rear cover 100*b* also includes wiring port release 126, in particular, wiring port release 126G, 126N, 126H and 126S (FIG. 1). The port release allows a wire inserted between the flexural tabs of a shark-bite connector to be released from the shark bite connector using a screwdriver or similar slender rigid implement. More specifically, a screwdriver or similar slender rigid implement can be inserted through wiring port release 126G, 126N, 126H and 126S (FIG. 1B) to engage with a flexural tab. By pressing against a flexural tab, the screwdriver or implement causes the flexural tab to disengage from the inserted wire to allow the inserted wire to be withdrawn.

Rear cover 100*b* also includes indentation 128 on its surface identifying and/or grouping wire interface ports 124 as corresponding to a neutral, ground, hot, or switched-hot electrical bus within device 100 (FIGS. 1B & 1C). In general, a device of the invention can include any function indicator effective to identify or group wire interface ports that are functionally equivalent. Wire interface ports are functionally equivalent if they are in alignment with wire shark-bite connectors that are on the same electrical bus. For example, the four wire interface ports 124N, which are grouped by indentation 128, are functionally equivalent, as they align with wire shark-bite connectors on the same electrical bus, in particular, electrical bus 130N, while the four wire interface ports 124G grouped by indentation 128 are functionally equivalent, as they align with wire shark-bite connectors on the same electrical bus, in particular, bus 130G. Similarly, the three wire interface ports 124H grouped by indentation 128 are functionally equivalent, as they align with wire shark-bite connectors on the same electrical bus, in particular, bus 130H. In addition to surface indentation such as indentation 128, a device of the invention can include function indicators such as ridges, as well as colored bands or strips surrounding or substantially surrounding one or more than one functionally equivalent wire interface ports. Alternatively, functionally equivalent wire interface ports can be indicated as such using a similar color outline or patch. Where color is used any conventional color codes can be utilized. For example, white can be used to indicate a neutral wire, green or yellow for a ground wire, and black or red for a hot or switched hot wire.

A cross-sectional view of electrical power transfer device 100 (FIG. 1C) illustrates the internal components of device 100. Front cover 100*f* and rear cover 100*b* form a substantially closed housing configured to enclose the four electrically-isolated electrical buses 130N (neutral wire), 130G (ground wire), 130H (hot wire), and 130S (switched-hot wire). Each electrical bus 130 (FIG. 2) has a generally elongated structure with a substantially flat reverse side and an obverse side having protruding terminal connectors (e.g. blade connector 140 and wire shark-bite connectors 134) extending toward 100*f*. Each electrical bus 130 is mounted to the interior side of rear cover 100*b*, its substantially flat, reverse surface generally flush against the interior side of rear cover 100*b* (FIG. 1C). The obverse side of each electrical bus 130 faces the interior cavity of device 100, its blade connector 140 and wire shark-bite connectors 134 protruding into the cavity of device 100 between front and rear covers 100*f* and 100*b*, respectively, as shown in FIG. 1C for buses 130H and 130S. Electrical buses 130N, 130G, and 130H are secured to the interior of rear cover 100*b* in a generally parallel arrangement as shown in FIG. 2. Electrical bus 130S is positioned, for convenience, beneath electrical 130H and is in vertical alignment with bus 130H so as to maintain a general parallel configuration relative to electrical buses 140N and 140G (FIG. 2). Any means known to those skilled in the art can be used to mount electrical bus 130 to the interior rear cover of device 100.

Example 2—Electrical Bus 130

FIG. 2 provides the structures of electrically isolated bus 130N, 130G, 130H and 130S. Each electrical bus 130 includes a flat, stem section 132 (e.g., 132N, 132G, 132H and 132S) from which at least two shorter, flat branch sections 133 (e.g., 133N, 133G, 133H and 133S) extend perpendicularly and unilaterally from one side of stem section 132, the unilateral branch sections 133 being co-planar with stem section 132. Preferably, the flat, stem section 132 and co-planar branch sections 133 are formed from a single strip of metal, the stem and branch sections 132 and 133 thereby forming a contiguous flat body having a reverse surface flush with the interior surface of rear cover 100*b* of the housing when mounted to the interior surface and an obverse surface oriented into the cavity of the device.

Each of electrical bus 130N, 130G, 130H and 130S includes at least one wire shark-bite connector (e.g., 134N, 134G, 134H and 134S) formed by a pair of similar, opposing flexural tabs 134 (shark-bites) that are effective to physically engage with a wire inserted between the opposing flexural tabs and counter withdrawal of the inserted wire against the direction of insertion. Each flexural tab 134 in the pair has a fixed end that perpendicularly adjoins an adjacent branch section 133 and a free end portion. The free end portions of the flexural tabs 134 extend in opposite direction relative to the free end portion of the other member of the pair and at an angle with respect to the plane of branch section 133. As such, the free end portions of each flexural tab in the pair converge forwardly of the plane of branch 133 within the cavity of device 100. The converging edges of opposing flexural tabs 134 engage with an exposed wire inserted between the tabs to form mechanical and electrical connections with the inserted wire, the inwardly biased flexural tabs 134 preventing withdrawal of the inserted wire.

Each electrical bus also includes a U-shaped blade connector 140 (e.g., 140N, 140G, 140H and 140S) adjoining one end of electrical bus 130 so as to protrude into the cavity of device 100 to receive a blade contact advanced through front cover 100*f*. Each U-shaped blade connector 140 includes two flat side plates joined by an arcuate section. The flat side plates and arcuate section form a U-shaped slot for receiving a blade contact from an interface component. Each U-shaped, blade connector 140 is dimensioned to allow a blade contact to fit snugly within the U-shaped slot thereby enabling secure mechanical and electrical connections between an inserted blade contact and the U-shaped blade connector 140 (FIG. 4C). Other embodiments of the blade connector could take shapes other than the U-shape, providing for push-on connection and pull-off removal.

Electrical bus 130S (FIG. 2) is configured with flat stem 132S and two shorter, flat branch sections 133S projecting perpendicularly and unilaterally from the right edge of stem section 132S at each end of elongated stem 132S, branch sections 133S being co-planar with stem section 132S. Flat, stem section 132S and branch sections 133S are formed from a single strip of metal, sections 132S and 133S thereby forming a contiguous flat body having a reverse surface flush with the interior surface of rear cover 100*b* of the housing when mounted and an obverse surface oriented into the cavity of the device 100. Electrical bus 130S includes wire shark-bite connector 134S formed by a pair of similarly sized, opposing flexural tabs 134S (i.e. wire shark-bites) disposed between adjacent branch sections 133S that are effective to physically engage with a wire inserted between the flexural tabs and counter withdrawal of the inserted wire against the direction of insertion. Thus, each member of the pair of flexural tabs has a fixed end perpendicularly adjoining an adjacent branch section 133S and a free end portion extending in opposite directions relative to the free end portion of the other member of the pair at an angle with respect to the plane of branch section 133S. As such, the free ends of the flexural tabs in the pair converge forwardly of the plane of branch sections 133S to form a wire shark-bite connector within the cavity of device 100. The converging edges of opposing flexural tabs 134S engage with an exposed wire inserted between the tabs to form secure mechanical and electrical connections with the inserted wire, the inwardly biased flexural tabs 134S preventing withdrawal of the inserted wire. U-shaped blade connector 140S adjoins the lower edge of electrical bus 130S through a short attachment means interconnecting the outer edge of branch section 133S and the rear arcuate edge of blade connector 140S in an inverted orientation. U-shaped blade connector 140H is disposed forwardly of the plane of stem 132S within the cavity of device 100 as shown in FIG. 2 so as to receive and engage with a blade contact advanced through blade interface port 110S on front cover 100*f*.

Electrical bus 130H (FIG. 2) is configured with flat, elongated stem 132H and four shorter branch sections 133H projecting perpendicularly and unilaterally from the right edge of stem section 132H, branch sections 133H being co-planar with stem section 132H. Two of the four branch sections 133H are disposed at each end of elongated stem 132H, and the remaining two are evenly positioned along elongated stem 132H. Stem section 132H and branch sections 133H are integrally formed from a single strip of metal, sections 132H and 133H thereby forming a contiguous flat body having a reverse surface flush with the interior surface of rear cover 100*b* of the housing when mounted and an obverse surface oriented into the cavity of the device 100. Electrical bus 130H includes wire shark-bite connector 134H formed by a pair of similarly-sized, opposing flexural tabs 134H (wire shark-bites) disposed between adjacent branch sections 133H that are effective to physically engage with a wire inserted between the flexural tabs and counter withdrawal of the inserted wire against the direction of insertion. Thus, each member of the pair of flexural tabs has a fixed end perpendicularly adjoining an adjacent branch section 133H, and a free end portion extending in opposite direction relative to the free end portion of the other member of the pair at an angle with respect to the plane of branch section 133H. As such, the free ends of the flexural tabs in the pair converge forwardly of the plane of branch sections 133H to form a wire shark-bite connector within the cavity of device 100. The converging edges of opposing flexural tabs 134H engage with an exposed wire inserted between the converging edges to form secure mechanical and electrical connections with the inserted wire, the inwardly biased flexural tabs 134H preventing withdrawal of the inserted wire. U-shaped blade connector 140H adjoins the upper edge of electrical bus 130H through a short attachment means interconnecting the outer edge of branch section 133H and the rear arcuate edge of blade connector 140H in an upright orientation. U-shaped blade connector 140H is disposed forwardly of the plane of stem 132H within the cavity of device 100 as shown in FIG. 2 so as to receive and engage with a blade contact advanced through blade interface port 110H on front cover 100*f*.

Electrical bus 130N is configured with flat, elongated stem 132N and five shorter branch sections 133N projecting perpendicularly and unilaterally from the right edge of stem section 132N, branch sections 133N being co-planar with stem section 132N. Two of the five branch sections 133N are disposed at each end of elongated stem 132N, and the remaining three are evenly positioned along elongated stem 132N. Stem section 132N and branch sections 133N are integrally formed from a single strip of metal, sections 132N and 133N thereby forming a contiguous flat body having a reverse surface flush with the interior surface of rear cover 100*b* of the housing when mounted and an obverse surface oriented into the cavity of the device 100. Electrical bus 130N includes wire shark-bite connector 134H (wire shark bites) formed by a pair of similarly-sized, opposing flexural tabs 134N disposed between adjacent branch sections 133N that are effective to physically engage with a wire inserted between the flexural tabs and counter withdrawal of the inserted wire against the direction of insertion. Thus, each member of the pair of flexural tabs has a fixed end perpendicularly adjoining adjacent branch section 133N, and a free end portion extending in opposite direction relative to the free end portion of the other member of the pair at an angle with respect to the plane of branch section 133N. As such, the free ends of the flexural tabs in the pair converge forwardly of the plane of branch section 133N to form a wire shark-bite connector within the cavity of device 100. The converging edges of opposing flexural tabs 134N engage with an exposed wire inserted between the tabs thereby forming secure mechanical and electrical connections with the inserted wire, the inwardly biased flexural tabs 134H preventing withdrawal of the inserted wire. U-shaped blade connector 140N adjoins the upper edge of electrical bus 130N through a short attachment means interconnecting the outer edge of branch section 133N and the rear arcuate edge of blade connector 140N in an upright orientation. U-shaped blade connector 140N is disposed forwardly of the plane of stem 132N within the cavity of device 100 as shown in FIG. 2 so as to receive and engage with a blade contact advanced through blade interface port 110N on front cover 100*f*.

Electrical bus 130G has a substantially similar structure as electrical bus 130N. Electrical bus 130G is configured with flat, elongated stem 132G and five shorter branch sections 133G projecting perpendicularly and unilaterally from the right edge of stem section 132G, the branch sections 133G being co-planar with stem section 132G. Two of the five branch sections 133G are disposed at each end of elongated stem 132G, and the remaining three evenly disposed unilaterally along elongated stem 132G. Stem section 132G and branch sections 133G are integrally formed from a single strip of metal, sections 132G and 133G thereby forming a contiguous flat body having a reverse surface flush with the interior surface of rear cover 100*b* of the housing when mounted and an obverse surface oriented into the cavity of the device 100. Electrical bus 130G includes wire shark-bite connector 134G formed by a pair of similarly-sized, opposing flexural tabs 134G (wire shark-bite) disposed between adjacent branch sections 133G that are effective to physically engage with a wire inserted between the flexural tabs and counter withdrawal of the inserted wire against the direction of insertion. Thus, each member of the pair of flexural tabs has a fixed end perpendicularly adjoining an adjacent branch section 133G, and a free end portion extending in opposite direction relative to the free end portion of the other member of the pair at an angle with respect to the plane of branch section 133G. As such, the free ends of the flexural tabs in the pair converge forwardly of the plane of branch section 133G to form a wire shark-bite connector within the cavity of device 100. The converging edges of opposing flexural tabs 134G engage with an exposed wire advanced between the tabs to form secure mechanical and electrical connections with the advanced wire, the inwardly biased flexural tabs 134G preventing withdrawal of the advanced wire. U-shaped blade connector 140G adjoins the upper edge of electrical bus 130G through a short attachment means interconnecting the outer edge of branch section 133G and the rear arcuate edge of blade connector 140G in an upright orientation. U-shaped blade connector 140G is disposed forwardly of the plane of stem 132G within the cavity of device 100 as shown in FIG. 2 so as to receive a blade contact advanced through blade interface port 110G on front cover 100*f*.

In device 100, structurally similar buses 130N, 130G, and 130H are secured to the interior of rear cover 100*b* with their blade connector 140 oriented in the same direction, e.g. upwardly or in an upright orientation (FIG. 2). Buses 130N, 130G, and 130H are mounted in parallel configuration spaced to be physically and electrically isolated one from the other. Buses 130H and 130S are secured one beneath the other on the device housing, their wire shark-bite connectors 134 disposed on the same side of the buses, and the open ends of their respective blade connectors 140 oriented in opposite directions. More specifically, the open end of the hot bus blade connector is oriented upward (in upright orientation) and open end of the switched hot bus blade connector is oriented downward (in an inverted orientation). Vertically aligned buses 130H and 130S are mounted to the interior of rear cover 100*b* in parallel configuration with respect to buses 130N and 130G so as to be electrically isolated from buses 130N and 130G. Buses 130H and 130S are also electrically isolated one from the other though spacing 160 (FIG. 2). The physical separation between buses 130H and 130S enables the power supplied to electrical bus 130S to be controlled using a switched interface component that provides an electrical connection between electrical buses 130H and 130S when switched on thereby completing the circuit, the electrical connection between buses 130H and 130S being severed when the switched interface component is switched off disconnecting the electrical circuit.

Thus, each electrical bus 130 is configured with blade connector 140 at a first end and a plurality of substantially similar shark bite connectors 134 disposed in vertical series along one side of the bus beneath blade connector 140 (FIG. 2). Electrical buses 130N is configured with blade connector 140N at one end and four shark-bite connectors 134N disposed in vertical series along the right side of the bus beneath blade connector 140N (FIG. 2). Similarly, electrical bus 130G is configured with blade connector 140G at one end and four shark-bite connectors 134G disposed in vertical series along the right side of the bus beneath blade connector 140G (FIG. 2). Electrical bus 130H has a structure similar to electrical buses 130N and 130G with blade connector 140H at a first end and three shark bite connectors 134H disposed in vertical series along the right side of the bus beneath blade connector 140H (FIG. 2).

The plurality of wire shark-bite connectors 134 disposed in vertical series on electrical buses 130N, 130G, and 130H allow device 100 to form electrical connections with more than one power cable to concurrently receive and distribute electrical power. For example, electrical power can be received from a power supply cable connected to device 100 through a first set of wire shark-bite connectors, e.g. the first shark-bite connector 130N, 130G, and 130H from each bus. Electrical power received can be provided to two other devices through the second and third sets/rows of wire shark-bite connectors 134, the second set/row consisting of the second shark-bite connector 130N, 130G, and 130H from each bus, and the third set/row consisting of the third shark-bite connector 130N, 130G, and 130H from each bus.

Thus, device 100 can receive electrical power from a supply cable through the first row of wire shark-bite connectors 134N, 134G and 134H and distribute the power received to two additional devices through two cables connected to device 100 through the second and third rows of wire shark-bite connectors 134N, 134G and 134H. Power received by device 100 through the first set of wire shark-bite connector 134 can be distributed to a connected device on a switched-on or switched-off basis through the fourth set/row of wire shark-bite connectors 134, which consists of the fourth shark-bite connectors 130N and 130G from buses 130N and 130G, respectively, and the single, electrically-isolated shark-bite connector 134S on electrical bus 130S, connected to bus 130H through a switched-hot interface component. Similarly, the presence of blade connector 140 on electrical buses 130N, 130G, 130H and 130S allow device 100 to provide electrical power to an interface component electrically connected to device 100 through blade connectors 140.

Example 3—Electrical Connection within Receptacle Box

Electrical power transfer device 100 is sized to fit within a conventional receptacle box, for example as shown for box 400 (FIG. 3), and is configured to receive and distribute electrical power through wires or electrical cables routed through the receptacle box. For example, electrical power transfer device 100 receives electrical power from the attached power supply cable 420 and redistributes electrical power to another device or component through three-core power cable 430. Three-core power cables 420 and 430 are both routed through receptacle box 400, within which device 100 is housed. The electrical and mechanical connections among conducting components in device 100 are further illustrated in FIGS. 4A & 4B.

Figure 4A:
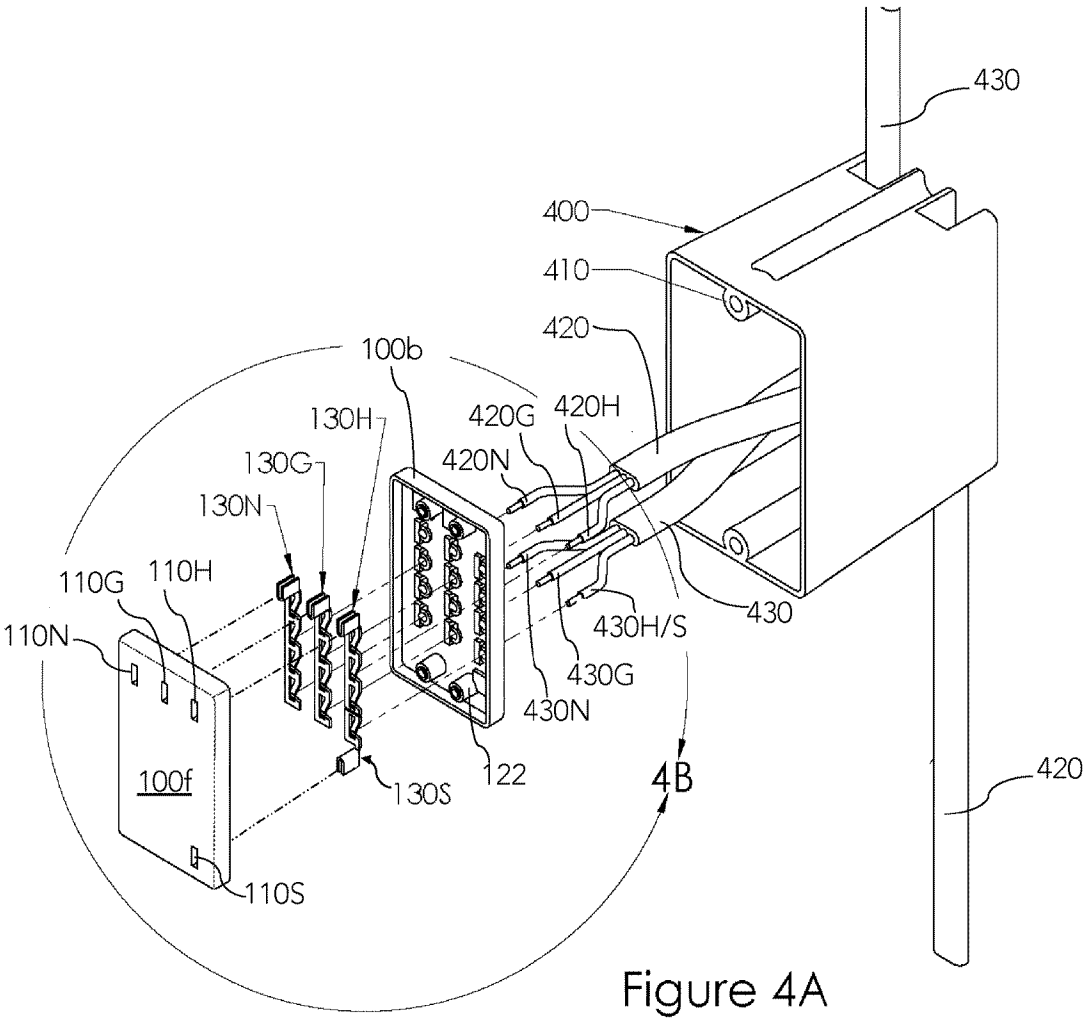
FIGS. 4A-4C are various perspective views of electrical power transfer device 100 including an exploded perspective view in relation to electrical power supply cable 420 and receptacle box 400 (4A), an enlarged view of section 4B shown in FIG. 4A (4B), and an enlarged view of section 4C shown in FIG. 4B (4C).
Figure 4C:
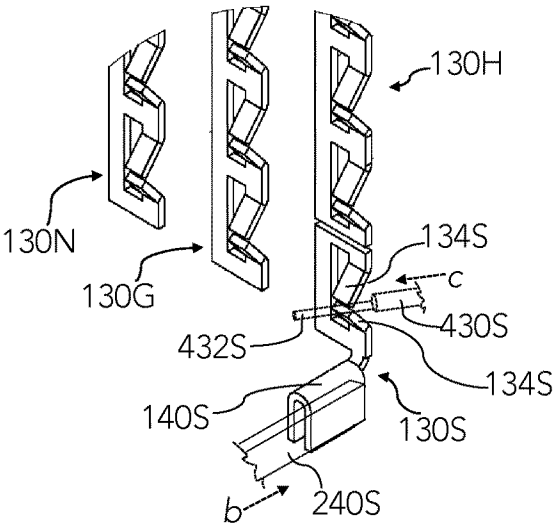
Figure 4B:
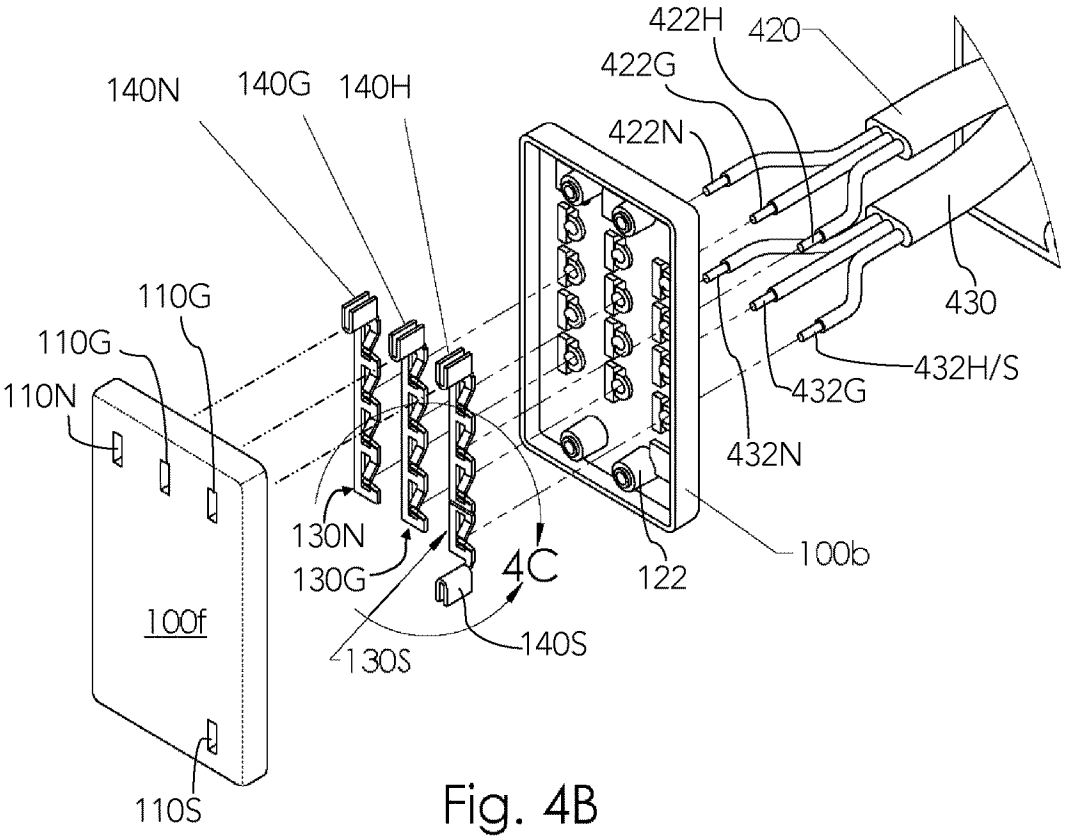

Power cable 420 is electrically connected to device 100 through three insulated conductor wires 420N, 420G and 420H (FIG. 4A). Wires 420N, 420G and 420H are provided with ends stripped to expose conductors 422N (neutral wire), 422G (ground wire) and 422H (hot wire), respectively, as known in the art (FIG. 4B). Electrical connection between the wires of power cable 420 and device 100 is formed by advancing the stripped end of a neutral, ground, and hot wire through a first set of designated wire interface ports 124N, 124G, and 124H on rear cover 100*b* (not shown) of device 100, respectively, and in turn, through opposing flexural tabs of wire shark-bite connectors 134N, 134G, and 134H of an electrical bus, respectively, within device 100. See, for example, wire 430S in FIG. 4C. When the wire end is fully inserted through shark-bite connector 134 of an electrical bus, the exposed conductor is secured between the opposing flexural tabs of shark-bite connector 134, the inwardly biased opposing flexural tabs countering any reverse movement of the inserted wire (i.e. movement in a direction of opposite to the direction indicated by arrow c) to prevent withdrawal of the wire and maintain secure mechanical and electrical interconnections between the wire and the flexural tabs. Thus, wires 420N, 420G and 420H of cable 420 are electrically connected to electrical buses 130N, 130G, and 130H of device 100, respectively, to provide power to device 100. Similarly, three-core power cable 430 is electrically connected to device 100 through three insulated conductor wires 430N, 430G and 430H/S (FIG. 4A), which are provided with ends stripped to expose conductor 432N (neutral wire), 432G (ground wire) and 432H/S (hot or switched-hot wire), respectively (FIG. 4B). When fully inserted into device 100 through wire interface port 124, each conductor wire engages with a wire shark-bite connector 134 on an electrical bus to form secure mechanical and electrical connections with the electrical bus, for example, as shown in FIG. 4C for wire 430S, and as discussed above for power supply cable 420.

Where a two-strand power supply cable is used to supply electrical power to a device of the invention, the wires can be connected to electrical bus 130N and 140H or 140S.

Electrical power supplied to device 100 by cable 420 is provided to an interface component through blade connector 140 on each electrical bus 130. As each blade interface port 110 on front cover 100*f* of device 100 is aligned with the blade connector 140 of each bus 130 (FIG. 1C), when a blade contact from an interface component is inserted into blade interface port 110, it is directed between the plates of blade connector 140, thereby forming secure mechanical and electrical connections with the plates as illustrated in FIG. 4C for blade contact 240S.

Example 4—Interconnection with Interface Components

Figure 5:
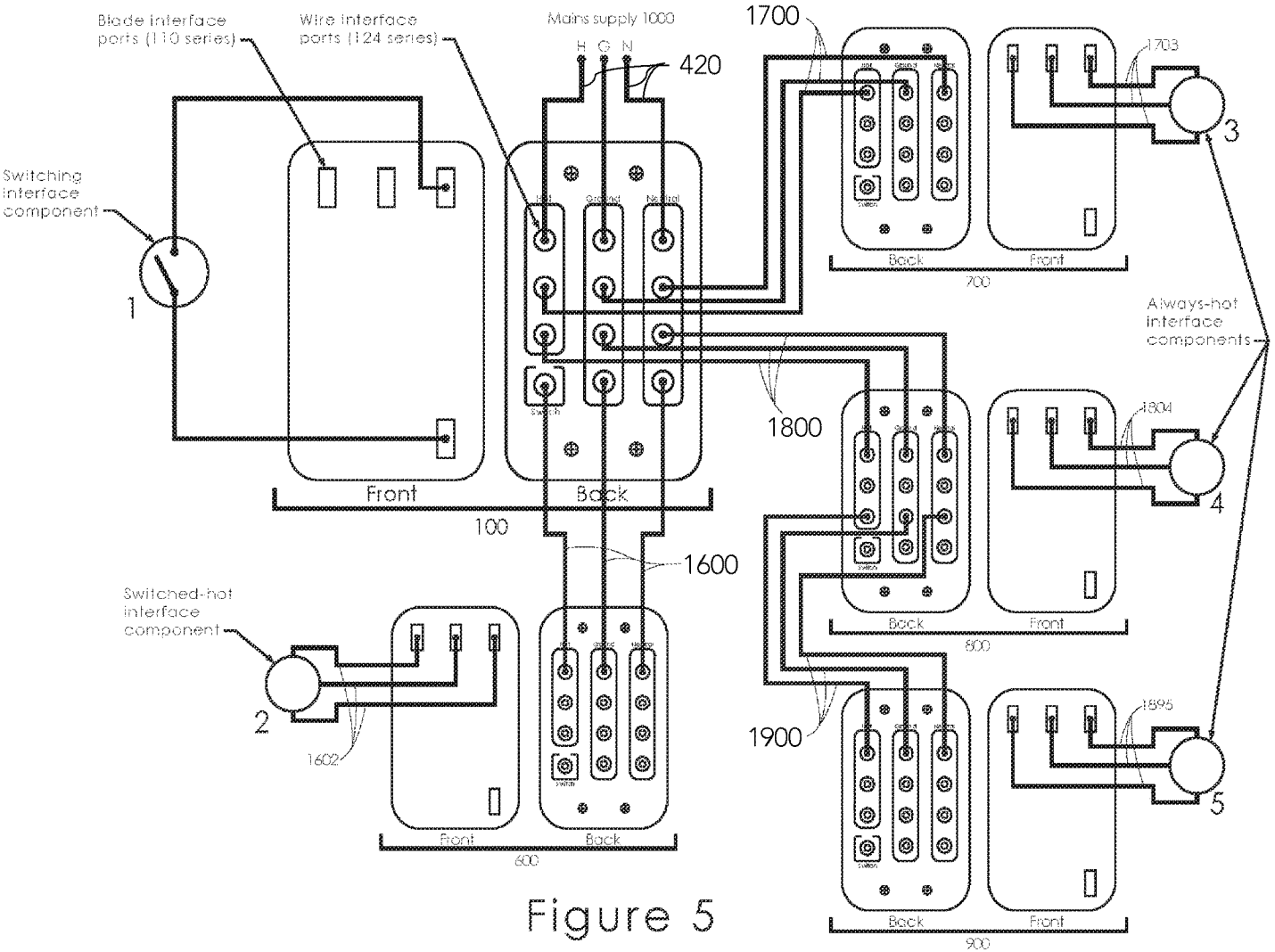
FIG. 5 is a diagram illustrating the interconnection and electrical power distribution that can be established among five electrical power transfer devices 100, 600, 700, 800 and 900 of the invention.

Electrical power transfer device 100 can be used to transfer electrical power directly to an interface component, as well as to one or more additional power transfer devices of the invention as illustrated in FIG. 5. Device 100 receives input electrical power directly from main supply 1000 through three-core supply cable 420. The neutral, ground and hot wires of power cable 420 provides electrical power to electrical buses 130N, 130G and 130H (not shown) of device 100, respectively, when advanced through the corresponding wire ports 124 at the rear of device 100 as described herein and shown in FIG. 5. Electrical (and mechanical) connections are formed between the stripped ends of neutral, ground, and hot wires of power cable 420 and shark-bite connectors 134 (not shown) of the respective electrical buses 130 as illustrated in FIG. 4C and described in accompanying text.

Device 100 provides electrical power to EP transfer device 600 through switching interface component 1. Electrical buses 130H and 130S of device 100 are physically and electrically isolated one from the other within device 100. The blade contacts of switching interface component 1 are inserted into blade interface ports 110H and 110S of device 100 to form mechanical and electrical connections with blade connectors 140 of electrical buses 130H and 130S, respectively, thereby providing a conductive path between electrical buses 130H and 130S. When switching interface component 1 is switched on, electrical power flows from bus 130H to bus 130S through switching interface component 1 thereby energizing bus 130S. Electrical power provided to 130S is distributed to device 600 through cable 1600. The neutral, ground and hot wires of power cable 1600 electrically connect device 100 to 600 through wire interface ports 124N, 124G, and 124H on the rear of device 100 and wire interface ports 124N, 124G, and 124S on the rear of device 600, respectively (FIG. 5). When switching interface component 1 is switched off, the conducting path is severed and electrical power does not pass from electrical bus 130H to electrical bus 130S resulting in no electrical power being provided to device 600.

Device 600 supplies electrical power to switched-hot interface component 2 through blade interface ports 110 on the front of device 600. The neutral, ground and hot blade contacts of switched-hot interface component 2, being advanced into blade interface ports 110 as represented by lines 1602, are electrically connected to the neutral, ground and hot electrical buses within device 600 through blade connectors 140 (not shown) on the electrical buses as illustrated and discussed herein. When interface component 1 is switched on, electrical power flows from device 100 to device 600 to switched-hot interface component 2, which in turn provides the electrical power to a connected appliance.

Device 100 also distributes electrical power in parallel to EP transfer devices 700 and 800 directly and to EP transfer device 900 indirectly through the remaining wire interface ports 124 as shown in FIG. 5. EP transfer device 100 distributes electrical power to device 700 through three-core power cable 1700. Power cable 1700 includes neutral, ground and hot wires having stripped ends that are inserted into respective interface ports 124 on the rear of devices 100 and 700 to form secure mechanical and electrical connections with corresponding electrical buses in devices 100 and 700 as discussed herein, thereby interconnecting the electrical buses of device 100 and device 700. Electrical power transfer device 700 supplies power to interface component 3 through blade interface ports 110 on the front of device 700. The neutral, ground and hot blade contacts of always-hot interface component 3, being advanced into blade interface ports 110 as represented by lines 1703, are electrically connected to the neutral, ground and hot electrical buses within device 700 through blade connectors 140 (not shown) of the electrical buses. As such, interface component 2 is always hot and provides electrical power to a connected appliance.

EP transfer device 100 distributes electrical power to device 800 through three-core power cable 1800. Power cable 1800 includes neutral, ground and hot wires having stripped ends that are inserted into respective wire interface ports 124 on the rear of devices 100 and 800 to form secure mechanical and electrical connections with the corresponding electrical buses in devices 100 and 800 as discussed herein, thereby interconnecting the electrical buses of device 100 and device 700. Electrical power transfer device 800 supplies power to interface component 4 through blade interface ports 110 on the front of device 800. The neutral, ground and hot blade contacts of always-hot interface component 4, being advanced into blade interface ports 110 as represented by lines 1804, are electrically connected to the neutral, ground and hot electrical buses within device 800 through blade connectors 140 (not shown) of the electrical buses. As such, interface component 4 is always hot and provides electrical power to a connected appliance.

EP transfer device 800 distributes electrical power to device 900 through three-core power cables 1900. Power cable 1900 includes neutral, ground and hot wires having stripped ends that are inserted into respective interface ports 124 on the rear of devices 800 and 900 to form secure mechanical and electrical connections with corresponding electrical buses in devices 800 and 900 as discussed herein, thereby interconnecting the electrical buses of device 800 and device 900. Electrical power transfer device 900 supplies power to interface component 5 through blade interface ports 110 on the front of device 900. The neutral, ground and hot blade contacts of always-hot interface component 5, being advanced into blade interface ports 110 as represented by lines 1905, are electrically connected to the neutral, ground and hot electrical buses within device 900 through blade connectors 140 (not shown) of the electrical buses. As such, interface component 5 is always hot and provides electrical power to a connected appliance.

Interface component 3, 4, and 5 are in an electrified state, for example, 120 V AC, when connected to electrical power transfer device 700, 800 and 900, respectively, as illustrated in FIG. 5, so long as device 700, 800, and 900 are in an energized state. Interface component 2 is electrified, for example, to 120 V AC, so long as switched-hot interface component 1 is switched on (or closed) to provide an electrical conductive path between electrical bus 130H and 130S of device 100. When switched-hot interface component 1 is switched off (or open), the circuit between buses 130H and 130S is severed, electrical bus 130S is not energized, and no power is provided to device 600.

Components and devices of the invention referenced in the figures are summarized below.

| | |
|---|---|
| Device 100 | Electrical bus 130 |
| Front cover 100f | Neutral 130N |
| Rear cover 100b | Ground 130G |
| Indentation 128 | Hot/positive 130H |
| Screw bosses 122 | Switched hot 130S |
| Blade interface port 110 | Blade connector 140 |
| Neutral 110N | Neutral 140N |
| Ground 110G | Ground 140G |
| Hot 110H | Hot 140H |
| Switched hot 110S | Switched hot 140S |
| Wire interface port 124 | Wire shark-bite connector 134 |
| Neutral 124N | Neutral 134N |
| Ground 124G | Ground 134G |
| Hot 124H | Hot 134H |
| Switched hot 124S | Switched hot 134S |
| Wire port release 126 | Hot bus separation 132 |
| Neutral 126N | Receptacle box 400 |
| Ground 126G | Receptacle box screw boss 410 |
| Hot 126H | Main power supply 1000 |
| Switched hot 126S | |
| Power supply cable 420 | Power supply cable 430 |
| Neutral wire 420N & exposed end 422N | Neutral wire 430N & exposed end 432N |
| Ground wire 420G & exposed end 422G | Ground wire 430G & exposed end 432G |
| Hot wire 420H & exposed end 422H | Hot wire 430H & exposed end 432H |
| Interface Components | Electrical Power Transfer Devices |
| Switching Interface Component 1 | Device 100 |
| Switched-hot Interface Component 2 | Device 600 |
| Always hot Interface Component 3 | Device 700 |
| Always hot Interface Component 4 | Device 800 |
| Always hot Interface Component 5 | Device 900 |

-continued

| Three-core Power Cables | Interface Blade Connection |
|---|---|
| Power cable 1600 | Switched-hot blade connection 1602 |
| Power cable 1700 | Always-hot blade connection 1703 |
| Power cable 1800 | Always-hot blade connection 1804 |
| Power cable 1900 | Always-hot blade connection 1905 |

OTHER EMBODIMENTS

The invention has been described broadly and generically herein. Each of the narrower species and subgeneric groupings falling within the generic disclosure also form part of the invention. As used herein and in the appended claims, the singular forms "a," "an," and "the" include plural reference unless the context clearly dictates otherwise.

The foregoing description including specific examples, methods or embodiments are intended to illustrate and not limit the scope of the invention. The terms and expressions employed herein are used as terms of description and not of limitation. There is no intent in the use of such terms and expressions to exclude any equivalent of the features shown and described or covers thereof. Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. All patents and publications referenced or mentioned herein are indicative of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

What is claimed is:

1. An electrical power transfer device, which is adapted for use with an electrical receptacle-type interface component, the device comprising a non-conductive housing having a front and a rear housing cover that form a cavity within which three physically isolated electrical buses are mounted, wherein each electrical bus of the three physically isolated electrical buses comprises:

(a) a flat body comprising a flat stem section and at least two flat branch sections extending perpendicularly from a side of the stem section, the at least two flat branch sections being co-planar with the stem section to form the flat body, the flat body comprising a flat reverse side mounted flush to an interior face of the rear housing cover;

(b) a wire shark-bite connector that extends into the cavity to effectively engage with a wire inserted through the rear housing cover, the wire shark-bite connector comprising a pair of converging flexural tabs, a first flexural tab of the pair extending from a first branch section of the at least two flat branch sections at a first angle with respect to the co-planar stem and branch sections toward a second flexural tab of the pair, the second flexural tab extending from a second branch section of the at least two flat branch sections toward the first flexural tab at a second angle to the co-planar stem and branch sections, the first and second angles being substantially similar in magnitude, the first and second branch sections being adjacent branch sections, the first and second flexural tabs being similarly sized, the first and second flexural tabs adjoining opposing edges of the first and second branch sections, the free end portions of the first and second flexural tabs converging forwardly of the co-planar stem and branch sections; and (c) a blade connector that extends toward the front housing cover to effectively engage with a blade contact inserted through the front housing cover, the blade connector comprising two plates joined by a midsection to form a slot for receiving the blade contact between the two plates to enable the blade contact to form mechanical and electrical connections with the blade connector, the blade connector adjoining the body of the electrical bus so as to be forward of the co-planar stem and branch sections and oriented to receive the blade contact between the two plates;

wherein the front housing cover comprises three blade interface ports, each positioned to align with the blade connector of one of the three physically isolated electrical buses; and wherein the rear housing cover comprises at least three wire interface ports, each positioned to align with the wire shark-bite connector of one of the three physically isolated electrical buses, and optionally, at least three wire shark-bite port releases, each positioned to align with the first or second flexural tab of the wire shark-bite connector of one of the three electrical buses.

2. The electrical power transfer device of claim 1, wherein at least one wire interface port is identified as corresponding to a neutral electrical bus, at least one wire interface port is identified as corresponding to a ground electrical bus, and at least one wire interface port is identified as corresponding to a hot electrical bus, the ports being identified using one or more letters, a color code, a circumscribing ridge or indentation, or any combination thereof.

3. The electrical power transfer device of claim 1, wherein each electrical bus of the three physically isolated electrical buses comprises two, three, four, five or six wire shark-bite connectors disposed in vertical series downward of the blade connector of each electrical bus, and wherein the rear housing cover comprises six, nine, twelve, fifteen or eighteen wire interface ports, respectively, each of the six, nine, twelve, fifteen or eighteen wire interface ports being aligned with one of the two, three, four, five or six wire shark-bite connectors.

4. The electrical power transfer device claim 3, wherein the blade connector of at least one of the three physically isolated electrical buses comprises a U-shape structure.

5. The electrical power transfer device claim 1, wherein the blade connector of at least one of the three physically isolated electrical buses comprises a U-shape structure.

6. The electrical power transfer device claim 1, wherein the blade connector of at least one of the three physically isolated electrical buses comprises a second midsection joining the two plates to form a closed structure, the slot extending from front to rear of the blade connector.

7. The electrical power transfer device claim 1, wherein at least one of the three physically isolated electrical buses comprises a conductive spring material.

8. The electrical power transfer device claim 1, wherein at least one of the three physically isolated electrical buses comprises copper, aluminum, brass, or a combination thereof.

9. An electrical power transfer device, which is adapted for use with an electrical switch-type interface component, the device comprising a non-conductive housing having a front and a rear housing cover that form a cavity within which four physically isolated electrical buses are mounted, wherein each electrical bus of the four physically isolated electrical buses comprises:

(a) a flat body comprising a flat stem section and at least two flat branch sections extending perpendicularly from a side of the stem section, the at least two flat branch sections being co-planar with the stem section to form the flat body, the flat body comprising a flat reverse side mounted flush to an interior face of the rear housing cover;

(b) a wire shark-bite connector that extends into the cavity to effectively engage with a wire inserted through the rear housing cover, the wire shark-bite connector comprising a pair of converging flexural tabs, a first flexural tab of the pair extending from a first branch section of the at least two flat branch sections at a first angle with respect to the co-planar stem and branch sections toward a second flexural tab of the pair, the second flexural tab extending from a second branch section of the at least two flat branch sections toward the first flexural tab at a second angle to the co-planar stem and branch sections, the first and second angles being substantially similar in magnitude, the first and second branch sections being adjacent branch sections, the first and second flexural tabs being similarly sized, the first and second flexural tabs adjoining opposing edges of the first and second branch sections, the free end portions of the first and second flexural tabs converging forwardly of the co-planar stem and branch sections; and (c) a blade connector that extends toward the front housing cover to effectively engage with a blade contact inserted through the front housing cover, the blade connector comprising two plates joined by a midsection to form a slot for receiving the blade contact between the two plates to enable the blade contact to form mechanical and electrical connections with the blade connector, the blade connector adjoining the flat body of the electrical bus so as to be forward of the co-planar stem and branch sections and oriented to receive the blade contact between the two plates;

wherein the front housing cover comprises four blade interface ports, each positioned to align with the blade connector of one of the four physically isolated electrical buses; and wherein the rear housing cover comprises at least four wire interface ports, each positioned to align with the wire shark-bite connector of one of the four physically isolated electrical buses, and optionally, at least four wire shark-bite port releases, each positioned to align with the first or second flexural tab of the wire shark-bite connector of one of the four electrical buses.

10. The electrical power transfer device of claim 9, wherein at least one wire interface port is identified as corresponding to a neutral electrical bus, at least one wire interface port is identified as corresponding to a ground electrical bus, at least one wire interface port is identified as corresponding to a hot electrical bus, and at least one wire interface port is identified as corresponding to a switched hot electrical bus, the ports being identified using one or more letters, a color code, a circumscribing ridge or indentation, or any combination thereof.

11. The electrical power transfer device of claim 9, wherein two of the four electrical buses each comprises four wire shark-bite connectors disposed in vertical series downward of the blade connector of each of the two electrical buses, and one of the four electrical buses comprises three wire shark-bite connectors disposed in vertical series downward of the blade connector of the one electrical bus.

12. The electrical power transfer device of claim 9, wherein the four physically isolated electrical buses comprises:

(a) a first electrical bus comprising a first set of four wire shark-bite connectors disposed in vertical series along one side of the first electrical bus downward of a first upright, U-shape blade connector on the first electrical bus;

(b) a second electrical bus comprising a second set of four wire shark-bite connectors disposed in vertical series along one side of the second electrical bus downward of a second upright, U-shape blade connector on the second electrical bus;

(c) a third electrical bus comprising three wire shark-bite connectors disposed in vertical series along one side of the third electrical bus downward of a third upright, U-shape blade connector on the third electrical bus; and (d) a fourth electrical bus comprising a wire shark-bite connector upward of an inverted, U-shaped blade connector on the fourth electrical bus;

wherein the front housing cover comprises four blade interface ports on its face, each positioned to align with the first, the second, the third or the fourth U-shape blade connector, and the rear housing cover comprises twelve wire interface ports, each positioned to align with one wire shark-bite connector of the first set of four wire shark-bite connectors, the second set of four wire shark-bite connectors, the three wire-shark bite connectors on the third electrical bus, or the wire-shark bite connector on the fourth electrical bus.

13. The electrical power transfer device of claim 12, wherein of the twelve wire interface ports, four wire interface ports are identified as corresponding to a neutral electrical bus, four wire interface ports are identified as corresponding to a ground electrical bus, three wire interface ports are identified as corresponding to a hot electrical bus, and one wire interface port is identified as corresponding to a switched-hot electrical bus, and wherein the ports are identified using one or more letters, color code, circumscribing ridge or indentation, or any combination thereof.

14. The electrical power transfer device claim 9, wherein the blade connector of at least one of the four physically isolated electrical buses comprises a U-shape structure.

15. The electrical power transfer device claim 9, wherein the blade connector of at least one of the four physically isolated electrical buses comprises a second midsection joining the two plates to form a closed structure, the slot extending from front to rear of the blade connector.

16. The electrical power transfer device claim 9, wherein at least one of the four physically isolated electrical buses comprises a conductive spring material.

17. The electrical power transfer device claim 9, wherein at least one of the four physically isolated electrical buses comprises copper, aluminum, brass, or a combination thereof.

18. A non-conductive housing comprising a front housing cover and a rear housing cover that combine to form an closed rectangular box having an inner cavity effective to house at least two electrical buses, each of which comprises:

(a) a flat body comprising a flat stem section and at least two flat branch sections extending perpendicularly from a side of the stem section, the at least two flat branch sections being co-planar with the stem section to form the flat body, the flat body comprising a flat reverse side mounted flush to an interior face of the rear housing cover;

(b) a wire shark-bite connector comprising a pair of converging flexural tabs, wherein a first flexural tab of the pair extends from a first branch section of the at least two flat branch sections at a first angle with respect to the co-planar stem and branch sections toward a second flexural tab of the pair, the second flexural tab extending from a second branch section of the at least two flat branch sections toward the first flexural tab at a second angle to the co-planar stem and branch sections, the first and second angles being substantially similar in magnitude, the first and second branch sections being adjacent branch sections, the first and second flexural tabs being similarly sized and adjoining opposing edges of the first and second branch sections, the free end portions of the first and second flexural tabs converging forwardly of the co-planar stem and branch sections; and (c) a blade connector comprising two plates joined by a midsection to form a slot for receiving a blade contact between the two plates to enable the blade contact to form mechanical and electrical connections with the blade connector, the blade connector adjoining the flat body so as to be forward of the plane of the stem and branch sections and oriented to receive the blade contact between the two plates;

wherein the non-conductive housing is effective to house the at least two electrical buses mounted to an interior surface of the rear housing cover, the at least two electrical buses' reverse sides flush against the interior surface, the at least two electrical buses being physically isolated one from the other; and wherein:

(a) The front housing cover comprises at least two blade interface ports, each positioned to align with the blade connector on one of the at least two electrical buses when the at least two electrical buses are mounted to the interior surface of the rear housing cover; and (b) The rear housing cover comprises at least two wire interface ports, each positioned to align with one of the wire shark bite connectors of the at least two electrical buses when the at least two electrical buses are mounted to the interior surface of the rear housing cover.

19. The non-conductive housing of claim 18, which is effective to house three physically isolated electrical buses, wherein:

(a) each electrical bus of the three physically isolated electrical buses comprises two, three, four, five or six of the wire shark-bite connectors disposed in vertical series downward of the blade connector of each electrical bus, each wire shark-bite connector of the two, three, four, five or six wire shark-bite connectors extending into the cavity of the housing to effectively engage with a wire inserted into the housing through the rear housing cover when each electrical bus is mounted to the interior surface of the rear housing cover;

(b) the blade connector of each electrical bus of the three physically isolated electrical buses extends toward the front housing cover to effectively engage with a blade contact inserted into the housing through the front housing cover when each electrical bus is mounted to the interior surface of the rear housing cover;

(c) the front housing cover comprises three blade interface ports, each positioned to align with the blade connector on one of the three physically isolated electrical buses when the three physically isolated electrical buses are mounted to the interior surface of the rear housing cover; and (d) the rear housing cover comprises six, nine, twelve, fifteen or eighteen wire interface ports, each positioned to align with one of the wire shark-bite connectors of the three physically isolated electrical buses when the three physically isolated electrical buses are mounted to the interior surface of the rear housing cover.

20. The non-conductive housing of claim 18, which is effective to house four physically isolated electrical buses, wherein the four physically isolated electrical buses comprises:

(a) a first electrical bus, each comprising four of the wire shark-bite connector disposed in vertical series along one side of each of the first and the second electrical bus downward of a first and a second U-shape blade connector of the first and the second electrical bus, respectively, the four wire shark-bite connectors each extending into the cavity of the housing to effectively engage with a wire inserted into the housing through the rear housing cover when the first and the second electrical bus are mounted to the interior surface of the rear housing cover;

(b) a third electrical bus comprising three of the wire shark-bite connector disposed in vertical series along one side of the third electrical bus downward of a third U-shape blade connector on the third electrical bus, the three wire shark-bite connectors each extending into the cavity of the housing to effectively engage with a wire inserted into the housing through the rear housing cover when the third electrical bus is mounted to the interior surface of the rear housing cover; and (c) a fourth electrical bus, wherein the blade connector comprises a fourth U-shape blade connector having an inverted, U-shape structure, and wherein the wire-shark bite connector is upward of the fourth, inverted, U-shape blade connector, the wire shark-bite connector extending into the cavity of the housing to effectively engage with a wire inserted into the housing through the rear housing cover when the fourth electrical bus is mounted to the interior surface of the rear housing cover;

wherein: (i) each of the first, second, third and fourth U-shape blade connectors extends toward the front housing cover to effectively engage with a blade contact inserted into the housing through the front housing cover; (ii) the front housing cover comprises four blade interface ports, each positioned to aligned with the first, second, third or fourth blade connector; and (iii) the rear housing cover comprises twelve wire interface ports, each positioned to align with one of the wire shark-bite connectors of the four electrical buses.

* * * * *